US010737907B2

(12) United States Patent
Guo et al.

(10) Patent No.: US 10,737,907 B2
(45) Date of Patent: Aug. 11, 2020

(54) STABILIZING DEVICE OF ELEVATOR CAR

(71) Applicant: Otis Elevator Company, Farmington, CT (US)

(72) Inventors: Junjie Guo, Zhejiang (CN); YuHang Ou, Zhejiang (CN); XiaoBin Tang, Tianjin (CN); Xiaokai Gong, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 260 days.

(21) Appl. No.: 15/690,723

(22) Filed: Aug. 30, 2017

(65) Prior Publication Data

US 2018/0127238 A1 May 10, 2018

(30) Foreign Application Priority Data

Aug. 30, 2016 (CN) ..... 2016 1 0756991

(51) Int. Cl.
*B66B 11/02* (2006.01)
*B66B 17/34* (2006.01)
(Continued)

(52) U.S. Cl.
CPC ..... *B66B 11/0293* (2013.01); *B66B 5/18* (2013.01); *B66B 7/041* (2013.01); *B66B 7/047* (2013.01);
(Continued)

(58) Field of Classification Search
CPC .. B66B 5/16; B66B 5/18; B66B 7/041; B66B 7/042; B66B 7/044; B66B 7/047; B66B 7/048; B66B 11/0293; B66B 17/34
See application file for complete search history.

(56) References Cited

U.S. PATENT DOCUMENTS 791,950 A * 6/1905 Seyffarth ..... B66B 5/18 187/370
3,077,953 A * 2/1963 Sahlin ..... B66B 7/047 187/409
(Continued)

FOREIGN PATENT DOCUMENTS

CN 205397800 U 7/2016
EP 1367017 B1 5/2010
(Continued)

OTHER PUBLICATIONS

European Search Report for application EP 17188478.6, dated Jan. 22, 2018, 6 pages.

*Primary Examiner* — Minh Truong
(74) *Attorney, Agent, or Firm* — Cantor Colburn LLP

(57) ABSTRACT

A stabilization apparatus of an elevator car includes: a base fixedly mounted with respect to the elevator car; an upper swing arm and a lower swing arm disposed in parallel basically, first ends thereof being pivotably fixed to the base; a guide rail friction member capable of generating, with the guide rail, a frictional force for keeping static with respect to the guide rail, and having a first connecting shaft and a second connecting shaft for being connected to the upper swing arm and the lower swing arm respectively; and a damper having at least one end connected to the upper swing arm or the lower swing arm, wherein the damper is configured to at least partially prevent the upper swing arm and the lower swing arm from relatively swinging, with the first connecting shaft and/or the second connecting shaft as a swinging pivot.

25 Claims, 10 Drawing Sheets

(51) Int. Cl.
*B66B 7/04* (2006.01)
*B66B 5/18* (2006.01)
*H01H 3/16* (2006.01)

(52) U.S. Cl.
CPC ..... *B66B 17/34* (2013.01); *H01H 3/16* (2013.01); *H01H 2231/03* (2013.01)

(56) References Cited

U.S. PATENT DOCUMENTS 4,072,213 A 2/1978 Salmon
4,079,816 A 3/1978 Ohta
4,174,025 A * 11/1979 Ivachev ..... F16D 65/28 188/106 F
5,641,041 A 6/1997 Masuda et al.
5,791,442 A * 8/1998 Arnold ..... H01F 5/00 188/138
5,862,888 A 1/1999 Iwakiri et al.
6,216,824 B1 4/2001 Fuller et al.
6,318,505 B1 * 11/2001 De Angelis ..... B66B 11/0293 187/292
7,377,371 B2 * 5/2008 Reuter ..... B66D 5/16 188/188
7,621,377 B2 11/2009 Husmann
7,793,763 B2 9/2010 Zhu et al.
8,011,478 B2 9/2011 Utsunomiya
8,123,002 B2 2/2012 Smith et al.
8,141,685 B2 3/2012 Utsunomiya
8,739,937 B2 6/2014 Fischer et al.
8,746,411 B2 6/2014 Roberts et al.
8,761,947 B2 6/2014 Wang
9,145,282 B2 * 9/2015 Schautt ..... B66B 5/18
9,359,172 B2 6/2016 Mangini et al.
9,915,307 B2 * 3/2018 Piech ..... F16D 63/008
10,167,171 B2 * 1/2019 Ladner ..... B66B 5/18
2007/0000732 A1 1/2007 Kulak et al.
2007/0272503 A1 * 11/2007 Kigawa ..... B66B 5/18 187/379
2011/0120809 A1 5/2011 Kocher et al.
2015/0027814 A1 1/2015 Benosman
2016/0023864 A1 1/2016 Roberts et al.
2016/0355377 A1 * 12/2016 Husmann ..... B66B 5/18
2018/0194595 A1 * 7/2018 Li ..... B66B 7/042

FOREIGN PATENT DOCUMENTS

GB 2314070 A 12/1997
JP 2002173284 A 6/2002
JP 2013142006 A 7/2013
JP 2015131695 A 7/2015
KR 20050004396 A 1/2005
WO 2015126377 A1 8/2015

* cited by examiner

STABILIZING DEVICE OF ELEVATOR CAR

FOREIGN PRIORITY

This application claims priority to Chinese Patent Application No. 201610756991.5, filed Aug. 30, 2016, and all the benefits accruing therefrom under 35 U.S.C. § 119, the contents of which in its entirety are herein incorporated by reference.

TECHNICAL FIELD

The present invention belongs to the field of elevator technologies, and relates to a stabilization apparatus of an elevator car and an elevator system using the stabilization apparatus.

BACKGROUND ART

An elevator car of an elevator system is dragged or hung by a dragging medium such as a steel wire or a steel belt. Especially, when the elevator car stops at a floor position to load/unload passengers or articles, the elevator car is hung by the steel wire or steel belt, so as to relatively stop in a shaft, thus facilitating loading or unloading.

However, the dragging medium such as the steel wire or steel belt is somewhat flexible. A great change in the weight of the elevator car during loading or unloading may easily cause vertical vibration of the elevator car, especially when the steel wire or steel belt is long. The elevator car is stopped unstably with respect to a floor position due to this vibration, thus causing poor passenger experience.

SUMMARY OF THE INVENTION

The present invention provides the following technical solutions to at least solve the above problems.

According to a first aspect of the present invention, a stabilization apparatus of an elevator car is provided, including:

a base fixedly mounted with respect to the elevator car;

an upper swing arm and a lower swing arm disposed in parallel basically, first ends thereof being pivotably fixed to the base;

a guide rail friction member capable of generating, with the guide rail, a frictional force for keeping static with respect to the guide rail, and having a first connecting shaft and a second connecting shaft for being connected to the upper swing arm and the lower swing arm respectively; and a damper having at least one end connected to the upper swing arm or the lower swing arm;

wherein the damper is configured to at least partially prevent the upper swing arm and the lower swing arm from relatively swinging, with the first connecting shaft and/or the second connecting shaft as a swinging pivot, along with the elevator car in a direction of the guide rail.

According to a second aspect of the present invention, an elevator system is provided, including a steel belt, an elevator car, and a guide rail, and further including a stabilization apparatus provided in the above first aspect.

According to a third aspect of the present invention, a stabilization apparatus of an elevator car is provided, including:

a base fixedly mounted with respect to the elevator car;

an adsorption electromagnet capable of generating, with a guide rail of an elevator, a frictional force for keeping static with respect to the guide rail;

a damper configured to at least partially prevent the base from moving along with the elevator car in a direction of the guide rail, an upper limit switch capable of being triggered when the adsorption electromagnet generates friction with respect to the guide rail and slides upward; and a lower limit switch capable of being triggered when the adsorption electromagnet generates friction with respect to the guide rail and slides downward.

According to a fourth aspect of the present invention, an elevator system is provided, including an elevator car and a guide rail, and further including a stabilization apparatus provided in the above second aspect.

According to a fifth aspect of the present invention, a method for detecting abrasion of an adsorption electromagnet of the stabilization apparatus with respect to a guide rail is provided, wherein the adsorption electromagnet is configured to be able to generate a predetermined maximum static frictional force when adsorbing the guide rail, and the damper basically works below a limit working condition when the frictional force is less than or equal to the predetermined maximum static frictional force;

wherein the method includes:

triggering the lower limit switch by downward sliding of the adsorption electromagnet with respect to the guide rail when the base moves downward along with the elevator car in the direction of the guide rail and an acting force generated by the elevator car and applied to the base is greater than the predetermined maximum static frictional force; and triggering the upper limit switch by upward sliding of the adsorption electromagnet with respect to the guide rail when the base moves upward along with the elevator car in the direction of the guide rail and an acting force generated by the elevator car and applied to the base is greater than the predetermined maximum static frictional force.

According to a sixth aspect of the present invention, a method for detecting that an adsorption electromagnet of a stabilization apparatus is stuck with respect to a guide rail is provided, wherein if the upper limit switch/lower limit switch is triggered when the elevator car runs normally along the rail or is triggered continuously, it is determined that the adsorption electromagnet does not return to its initial position, and it is determined that the adsorption electromagnet is stuck with respect to the guide rail.

The foregoing features and operations of the present invention will become more apparent according to the following descriptions and accompanying drawings.

BRIEF DESCRIPTION OF THE DRAWINGS

From the following detailed description with reference to the accompanying drawings, the foregoing and other objectives and advantages of the present invention would be more complete and clearer, wherein identical or similar elements are indicated with identical reference signs.

REFERENCE NUMERALS

Figure 1:
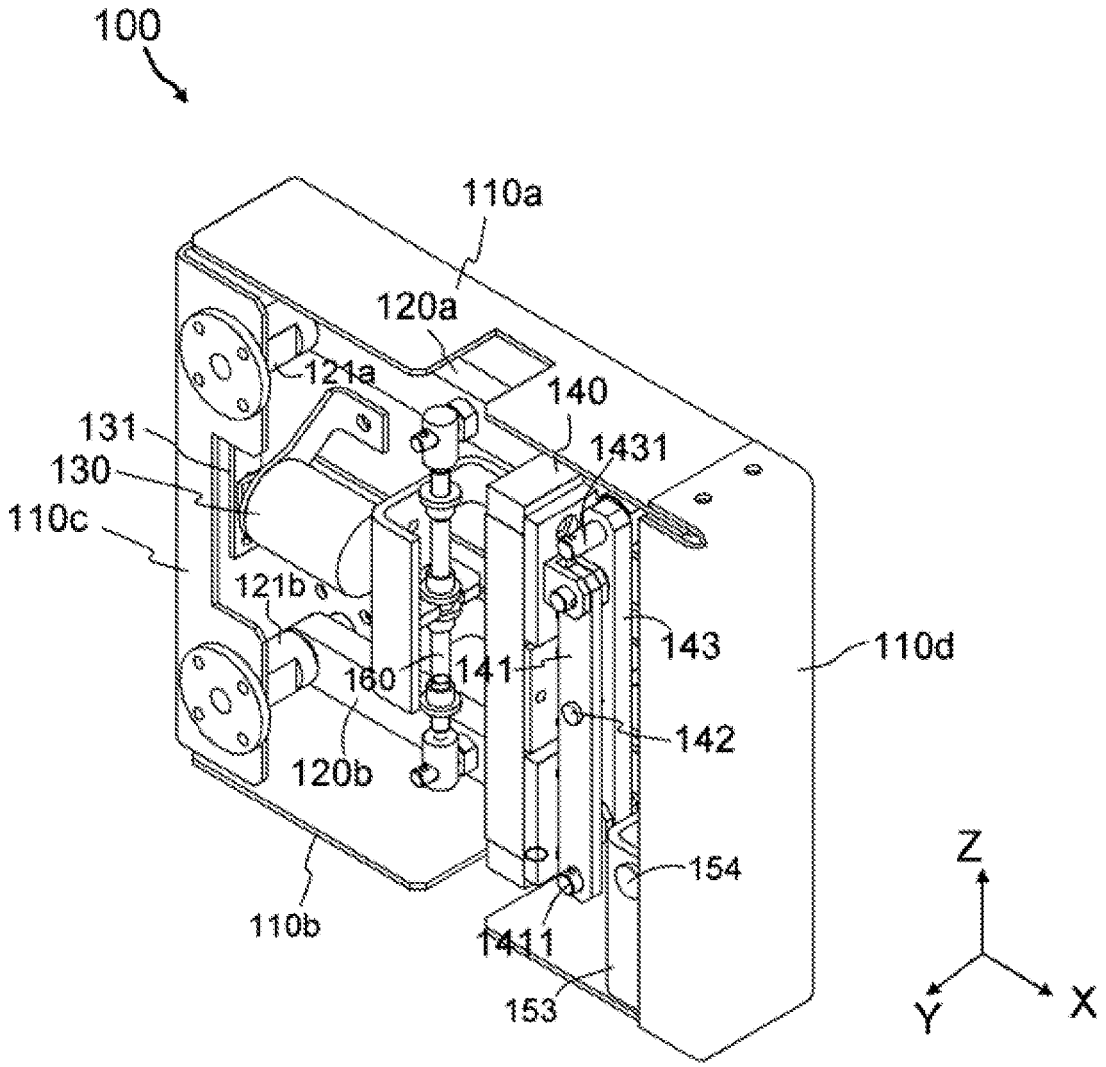
FIG. 1 is a three-dimensional schematic structural diagram of a stabilization apparatus of an elevator car according to a first embodiment of the present invention.

10—elevator system, 11—guide rail, 12—guide shoe, 13—elevator car,

14—steel belt, 100, 300—stabilization apparatus, 110—base,

110*a*, 310*a*—base upper flange, 110*b*, 310*b*—base lower flange,

110*c*, 310*c*—base left flange, 110*d*, 310*d*—right end cover,

120*a*, 320*a*—upper swing arm, 120*b*, 320*b*—lower swing arm,

121*a*, 321*a*—upper swing arm pivot shaft, 121*b*, 321*b*—lower swing arm pivot shaft,

130, 330—horizontal-push solenoid coil, 131, 331—return board,

132, 332—fixing bracket, 133, 333—horizontal-push connecting rod, 134, 334—horizontal piston rod,

140, 340—adsorption electromagnet, 141, 341—first connecting rod,

1411, 3411—second connecting shaft, 142, 342—central pin,

143, 343—second connecting rod, 1431, 3431—first connecting shaft,

150, 350—hydraulic buffer, 151—vertical piston rod, 152—piston rod pivot shaft,

153—hydraulic buffer bearing seat, 154—hydraulic buffer pivot shaft,

160, 360—reset rod, 161, 361—reset rod supporting seat,

162*a*, 162*b*, 362*a*, 362*b*—pivot shaft, 163—limiting sleeve,

164*a*, 364*a*—upper reset spring, 164*b*, 364*b*—lower reset spring,

351*a*—upper piston rod, 351*b*—lower piston rod, 352*a*—upper piston rod pivot shaft,

352*b*—lower piston rod pivot shaft,

170*a*, 370*a*—upper limit switch, 170*b*, 370*b*—lower limit switch.

DETAILED DESCRIPTION

The present invention is now described more completely with reference to the accompanying drawings. Exemplary embodiments of the present invention are illustrated in the accompanying drawings. However, the present invention may be implemented in lots of different forms, and should not be understood as being limited to the embodiments described herein. On the contrary, the embodiments are provided to make the disclosure to be thorough and complete, and fully convey the concept of the present invention to those skilled in the art.

For clarity and simplicity of the description, all of the multiple components shown in the accompanying drawings are not described in detail in the following description. Multiple components that can completely implement the present invention by those skilled in the art are shown in the accompanying drawings, and for those skilled in the art, operations of various components are familiar and apparent.

In the following illustration, for the convenience of illustration, a direction of a guide rail corresponding to an elevator is defined as a Z direction, a direction where an initial position of a swing arm of a stabilization apparatus of an elevator car locates is defined as an X direction, and a direction perpendicular to the X direction and the Z direction is defined as a Y direction. It should be understood that, the definitions of these directions are used for relative descriptions and clarification, and can be changed correspondingly according to changes in orientations of a speed governor.

In the following embodiments, orientation terms "upper" and "lower" are defined based on the Z direction, direction terms "left" and "right" are defined based on the X direction, and the direction terms "front" and "rear" are defined based on the Y direction. Moreover, it should be understood that, these directional terms are relative concepts, and they are used for relative descriptions and clarification and can be changed correspondingly according to changes in the orientation to which the stabilization apparatus is mounted.

First Embodiment

A stabilization apparatus 100 of an elevator car according to a first embodiment of the present invention is exemplified below in detail with reference to FIG. 1 to FIG. 8.

Figure 5:
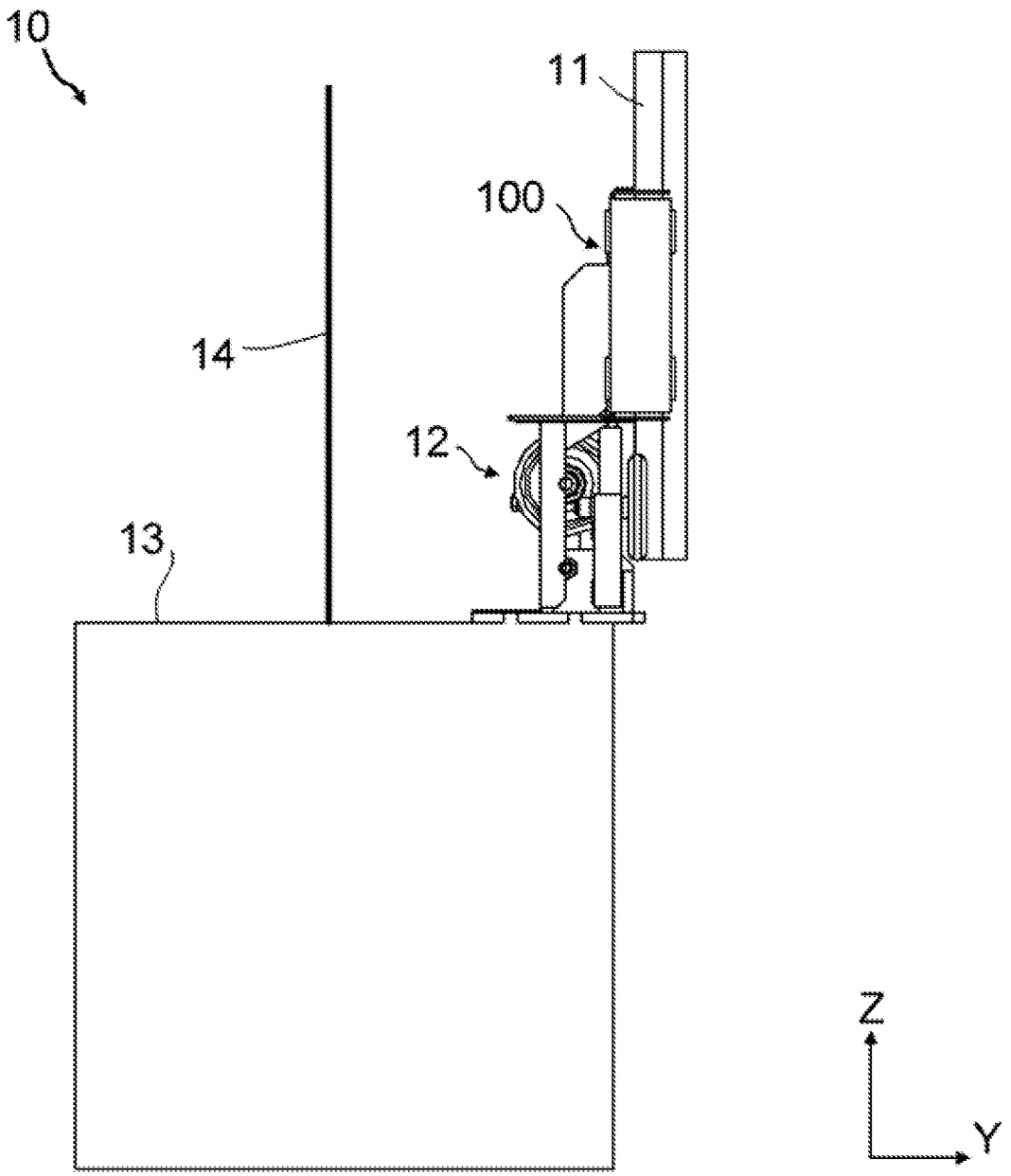
FIG. 5 is a front view of an elevator system mounted with the stabilization apparatus of the embodiment shown in FIG. 1 according to an embodiment of the present invention.
Figure 6:
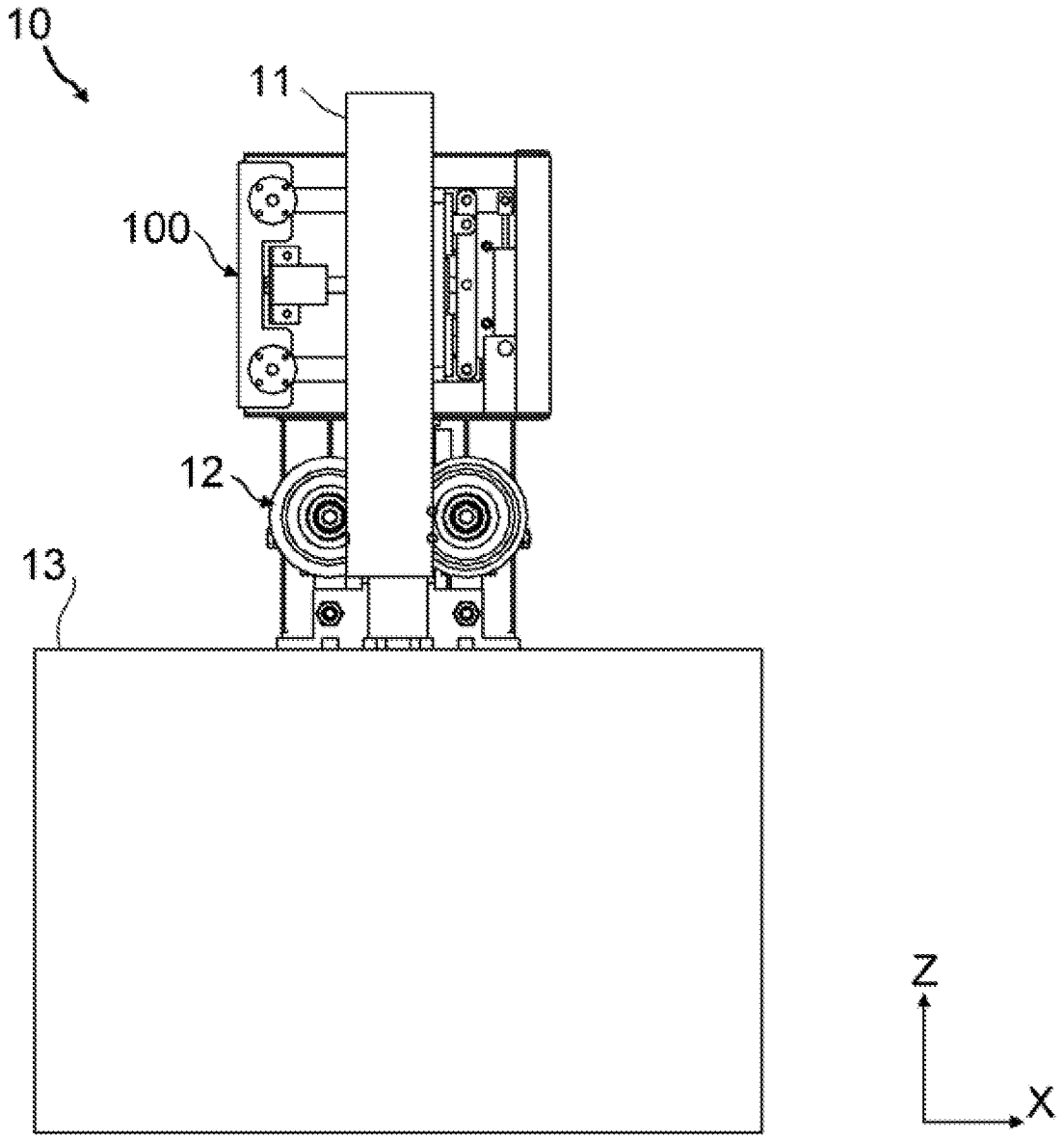
FIG. 6 is a side view of an elevator system mounted with the stabilization apparatus of the embodiment shown in FIG. 1 according to an embodiment of the present invention.

The stabilization apparatus 100 is mounted on an elevator car 13. Specifically, as shown in FIG. 5 and FIG. 6, the stabilization apparatus 100 is mounted on a guide shoe 12 of the elevator car 13. The stabilization apparatus 100 may be mounted on an upper guide shoe or a lower guide shoe, or may be mounted on the upper guide shoe and the lower guide shoe simultaneously. Specifically, the mounting may be selected according to a principle of not affecting normal running of the elevator car 13 in a shaft. For example, the stabilization apparatus 100 may even be mounted on a component of the elevator car 13 other than the guide shoe 12. The major function of the stabilization apparatus 100 according to the embodiment of the present invention is reducing the vertical vibration of the elevator car 13 in the Z direction when the elevator car 13 stops at a landing of a floor (for example, when a floor-door of the landing is opened).

Figure 2:
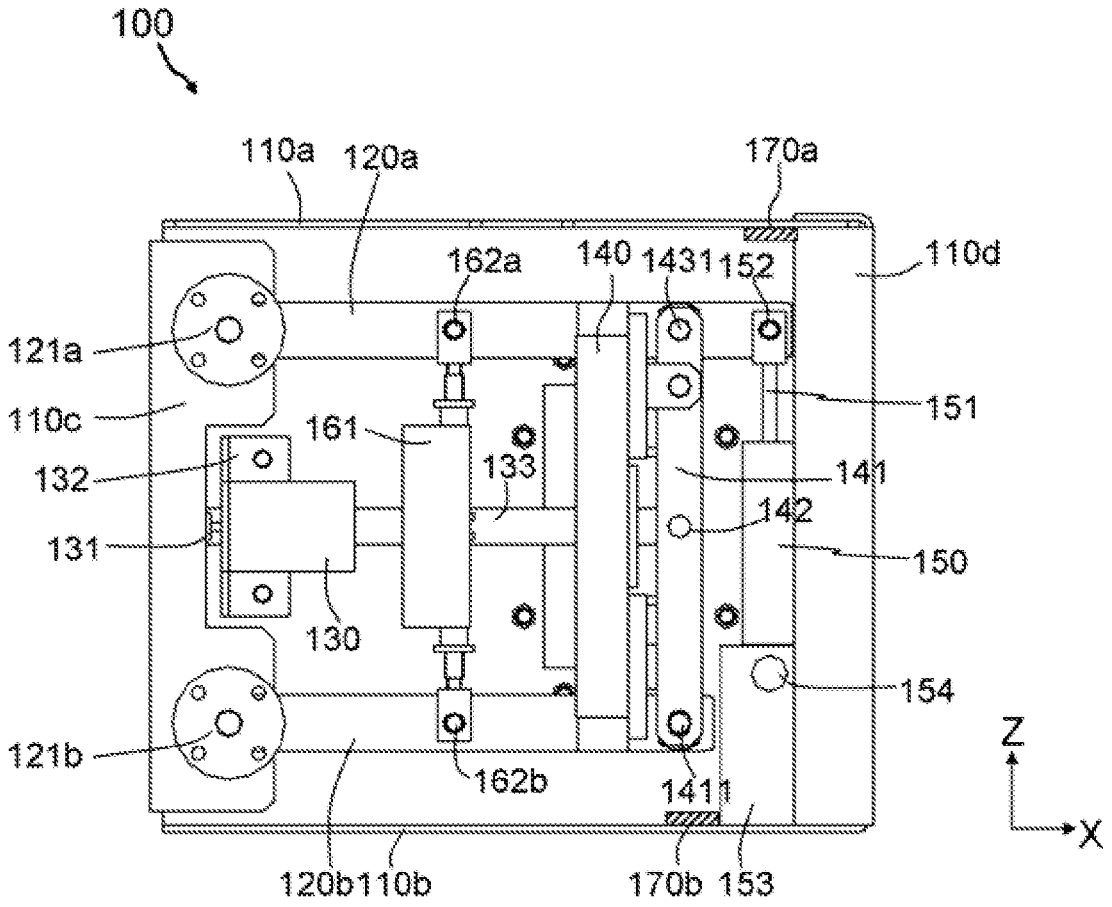
FIG. 2 is a front view of the stabilization apparatus of the embodiment shown in FIG. 1.
Figure 3:
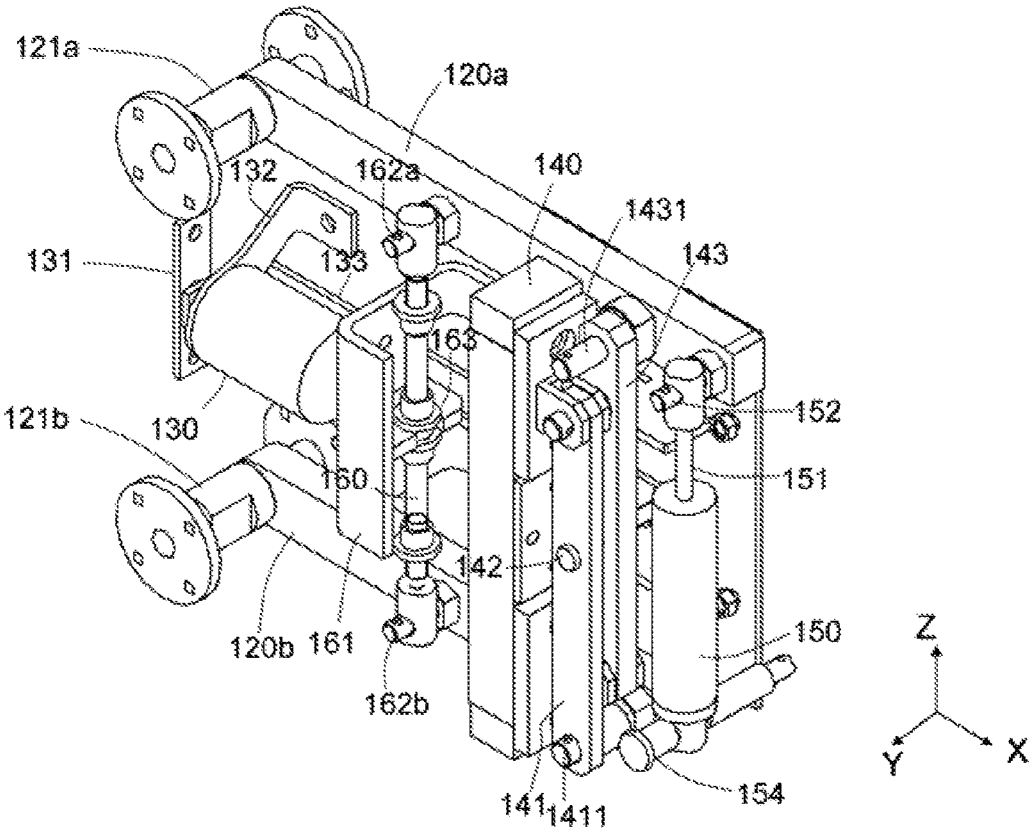
FIG. 3 is a three-dimensional schematic diagram of an internal structure of the stabilization apparatus of the embodiment shown in FIG. 1.
Figure 4:
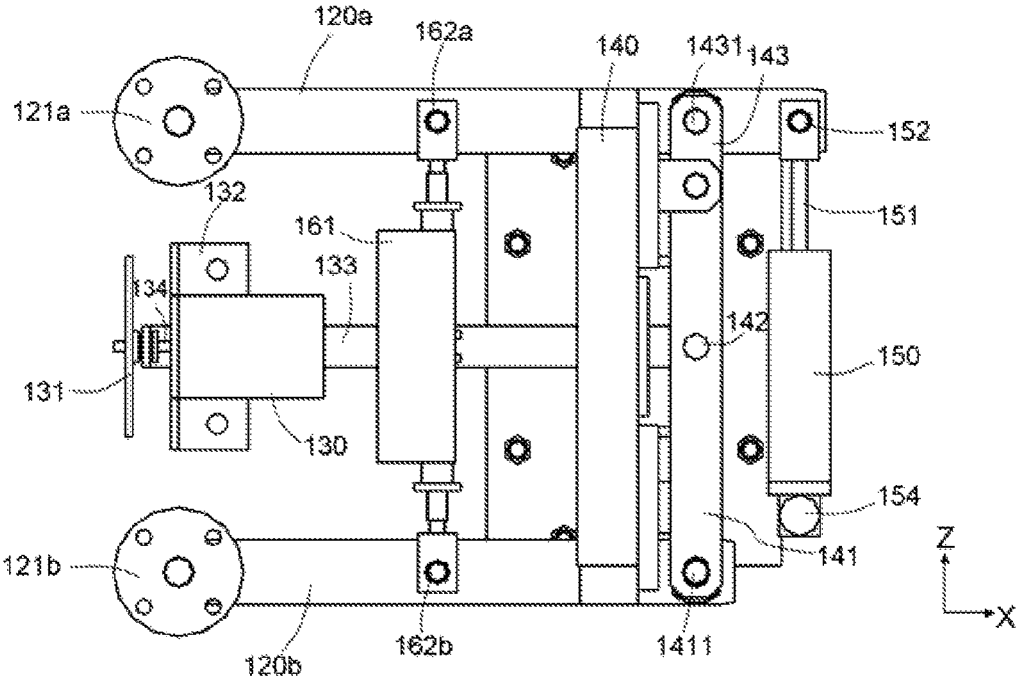
FIG. 4 is a front view of the internal structure of the stabilization apparatus of the embodiment shown in FIG. 1.

As shown in FIG. 1 to FIG. 7, the stabilization apparatus 100 includes a base 110. The base 110 is fixedly mounted relative to the elevator car 13, for example, fixedly mounted on a guide shoe 12 of the elevator car 13. In this embodiment, the base 110 may substantially be plate shaped. An upper edge of the plate is bent substantially perpendicularly towards the Y direction to form a base upper flange 110*a*, a lower edge of the plate is bent substantially perpendicularly towards the Y direction to form a base lower flange 110*b*, a left edge of the plate is bent substantially perpendicularly towards the Y direction and then bent substantially perpendicularly towards the X direction to form a base left flange 110*c*, and a right end cover 110*d* is detachably mounted at the right of the base 110. In this way, a semi-closed space is formed by enclosure of the base upper flange 110*a*, the base lower flange 110*b*, the base left flange 110*c*, and the right end cover 110*d*, to accommodate an internal structure of the stabilization apparatus 100 as shown in FIG. 3. Notches for accommodating a guide rail 11 may be formed on the base upper flange 110*a* and the base lower flange 110*b* respectively.

The internal structure of the stabilization apparatus 100 is provided with an upper swing arm 120*a* and a lower swing arm 120*b*. The upper swing arm 120*a* and the lower swing arm 120*b* are disposed substantially parallel to each other, wherein a left end of the upper swing arm 120*a* is pivotably fixed on the base 110. Specifically, the upper swing arm 120*a* is fixed on the base 110 via an upper swing arm pivot shaft 121*a* provided in the Y direction. In this way, the upper swing arm 120*a* may substantially rotate or swing about the upper swing arm pivot shaft 121*a* on a YZ plane, and a position point of the upper swing arm pivot shaft 121*a* on the upper swing arm 120*a* is a pivot point at a left end of the upper swing arm 120*a*. Likewise, the lower swing arm 120*b* is fixed on the base 110 via a lower swing arm pivot shaft 121*b* provided in the Y direction. In this way, the lower swing arm 120*b* may substantially rotate or swing about the lower swing arm pivot shaft 121*b* on the YZ plane, and a position point of the lower swing arm pivot shaft 121*b* on the lower swing arm 120*b* is a pivot point at a left end of the lower swing arm 120*b*. Specifically, both ends of the upper swing arm pivot shaft 121*a* and the lower swing arm pivot shaft 121*b* may be fixed to the base 110 and the base left flange 110*c* respectively.

The internal structure of the stabilization apparatus 100 is provided with a guide rail friction member capable of generating, with the guide rail 11, a frictional force for keeping static with respect to the guide rail 11, and the guide rail friction member has a first connecting shaft 1431 and a second connecting shaft 1411 for being connected to the upper swing arm 120*a* and the lower swing arm 120*b* respectively. Specifically, in this embodiment, the guide rail friction member is adsorbed on the guide rail 11 by using an electromagnet to generate a frictional force, and specifically includes an adsorption electromagnet 140 and a scissor-shaped linkage mechanism. The adsorption electromagnet 140 is fixed at one side, close to the guide rail 11, of the scissor-shaped linkage mechanism. The adsorption electromagnet 140 may generate an adsorption force on the guide rail 11 after being powered on or electrified, thereby generating the frictional force between surfaces of the adsorption electromagnet 140 and the guide rail 11. The specific type of the adsorption electromagnet 140 is not limited. A maximum static frictional force between the adsorption electromagnet 140 and the guide rail 11 may be controlled by setting a frictional coefficient of an adsorption plane of the adsorption electromagnet 140 and/or the magnitude of an adsorption force that can be generated by the adsorption electromagnet 140, or the like, that is, a predetermined maximum static frictional force is formed.

The scissor-shaped linkage mechanism is formed a first connecting rod 141 and a second connecting rod 143 crossing each other. The first connecting rod 141 and the second connecting rod 143 are pivotally connected through a central pin 142. One end of the first connecting rod 141 is pivotably connected to an upper portion of the adsorption electromagnet 140, and the other end of the first connecting rod 141 is connected to the lower swing arm 120*b* via the second connecting shaft 1411. One end of the second connecting rod 143 is pivotably connected to a lower portion of the adsorption electromagnet 140, and the other end of the second connecting rod 143 is connected to the upper swing arm 120*a* via the first connecting shaft 1431. Moreover, the central pin 142 passes through pin holes in the middle of the first connecting rod 141 and the second connecting rod 143. The lengths of the first connecting rod 141 and the second connecting rod 143 are set (for example, they are set to have the same length) such that the adsorption plane of the adsorption electromagnet 140 fixed on the scissor-shaped linkage mechanism is basically parallel to the guide rail 11. In this case, when the central pin 142 is pulled towards the negative X direction, the scissor-shaped linkage mechanism may push the adsorption electromagnet 140 to approach or contact with the surface of the guide rail 11. When the central pin 142 is pushed towards the positive X direction, the scissor-shaped linkage mechanism may push the adsorption electromagnet 140 away from the surface of the guide rail 11 to return to an initial position. In the above process, the adsorption electromagnet 140 may be kept to move in the X direction, and it is unnecessary to set a guiding apparatus for the movement of the adsorption electromagnet 140 in the X direction. The structure is simple and the operation is convenient. Moreover, the scissor-shaped linkage mechanism may provide redundant rotation at a fine tuning angle on an XZ plane for the adsorption electromagnet 140, such that the adsorption electromagnet 140 can be completely attached to and contact with the surface of the guide rail 11 when applying an adsorption force. In an embodiment, the pin hole in the first connecting rod 141 or the second connecting rod 143 is set to a kidney shaped hole; this may increase the redundant rotation at the fine tuning angle.

In the stabilization apparatus 100 of this embodiment, the pivot point at the left end of the upper swing arm 120*a* (that is, the position corresponding to the upper swing arm pivot shaft 121*a*), the pivot point at the left end of the lower swing arm (that is, the position corresponding to the upper swing arm pivot shaft 121*b*), a connecting point of the first connecting shaft 1431 with the upper swing arm 120*a*, and a connecting point of the second connecting shaft 1411 with the lower swing arm 120*b* substantially form four angular points of a parallelogram. That is, the upper swing arm 120*a*, the lower swing arm 120*b*, and the guide rail friction member limit each other to substantially form a parallelogram. Moreover, it should be understood with reference to the following illustrations that, the shape of the parallelogram changes when the upper swing arm 120*a* and the lower swing arm 120*b* swing vertically along with the elevator car 13; however, side lengths thereof are not changed. When the stabilization apparatus 100 is in a non-working state, the adsorption electromagnet 140 is away from the surface of the guide rail 11. The parallelogram is substantially a rectangle. At this time, the upper swing arm 120*a*, the lower swing arm 120*b*, and the adsorption electromagnet 140 are correspondingly located at initial positions thereof.

Still referring to FIG. 1 to FIG. 7, the internal structure of the stabilization apparatus 100 is further provided with a damper. An upper end of the damper is connected to a right end of the upper swing arm 120*a*, and a lower end thereof is pivotably fixed with respect to the base 110. Specifically, the damper includes a hydraulic buffer 150 and a vertical piston rod 151. An upper end of the vertical piston rod 151 is pivotably connected to the right end of the upper swing arm 120*a* via a piston rod pivot shaft 152. A hydraulic buffer bearing seat 153 is disposed under the hydraulic buffer 150, and is disposed fixedly with respect to the base 110. A lower end of the hydraulic buffer 150 is pivotably fixed to the hydraulic buffer bearing seat 153 via a hydraulic buffer pivot shaft 154. In this way, the damper can rotate about the hydraulic buffer pivot shaft 154 in the XZ plane, and definitely can rotate about the hydraulic buffer pivot shaft 152 simultaneously.

It should be noted that, the hydraulic buffer 150 may include a structure such as an oil cylinder. On one hand, the hydraulic buffer 150 will also synchronously move vertically while the base 110 moves vertically along with the elevator car 13. On the other hand, the right end of the upper swing arm 120*a* will also swing vertically while the upper swing arm 120*a* swings with the first connecting shaft 1431 as a swinging pivot, thus driving the vertical piston rod 151 to move vertically. Therefore, the vertical piston rod 151 can perform piston movement with respect to the hydraulic buffer 150. When the vertical piston 151 moves away from the hydraulic buffer 150, a counter-acting force will be generated to prevent it from moving away. In contrast, when the vertical piston 151 moves close to the hydraulic buffer 150, a counter-acting force will be generated to prevent it from moving closer. When the oil cylinder of the hydraulic buffer 150 is fixed, the counter-acting force will be delivered and applied to the base 110 connected to the right end of the upper swing arm 120*a* and the lower end of the hydraulic buffer 150, thereby at least partially preventing the upper swing arm 120*a* (and the lower swing arm 120*b* at the same time) from swinging along with the elevator car 13. The faster the swinging speed is, the larger the generated counter-acting force is. Therefore, the damper in the embodiment specifically disclosed above has characteristics of a single-rod bidirectional damper.

Moreover, the damper in the above embodiment is deployed at the right end of the upper swing arm 120*a*. Therefore, the upper swing arm pivot shaft 121*a* and the lower swing arm pivot shaft 121*b* are located at the left side of the guide rail 11, and the damper and the guide rail friction member are both located at the right side of the guide rail (referring to FIG. 7). In other words, the left end of the upper swing arm 120*a* is located relatively at the left side of the guide rail 11, the right end of the upper swing arm 120*b* is located relatively at the right side of the guide rail 11, the damper is disposed at the right end of the upper swing arm 120*b*, and the first connecting shaft 1431 corresponding to the guide rail friction member is also located relatively at the right side of the guide rail 11 on the upper swing arm 120*a*. Therefore, the parallelogram where the upper swing arm 120*a* locates can swing vertically as a whole with the first connecting shaft 1431 as a swing pivot. Based on the level principle, when a ratio R of a distance between the piston rod pivot shaft 152 and the swing pivot to a distance between the upper swing arm pivot shaft 121*a* (that is, a pivot point at the left end of the upper swing arm 120*a*) and the swing pivot is determined, the magnitude of displacement of the piston rod pivot shaft 152 (that is, the vertical piston rod 151) may also be determined according to the magnitude of displacement (caused by the swing) of the upper swing arm pivot shaft 121*a* in the Z direction. Specifically, the ratio R may be determined according to a stroke range requirement of the vertical piston rod 151 relative to the hydraulic buffer 150.

In an embodiment, the ratio R of the distance between the piston rod pivot shaft 152 and the swing pivot to the distance between the upper swing arm pivot shaft 121*a* (that is, the pivot point at the left end of the upper swing arm 120*a*) and the swing pivot is less than or equal to ½. In this way, the stroke range requirement of the vertical piston rod 151 relative to the hydraulic buffer 150 is relatively small, thus being conducive to reducing the cost of the damper. More specifically, the ratio R is set to be less than or equal to, for example, ⅕. For example, the first connecting shaft 1431 is disposed on the upper swing arm 120*a* near the right end of the upper swing arm 120*a*, and the distance between the piston rod pivot shaft 152 and the swing pivot is relatively small.

By taking that the base 110 moves downward by a distance L as an example, the left ends of the upper swing arm 120*a* and the lower swing arm 120*b* also swing downward by the distance L, and the hydraulic buffer 150 also moves downward by the distance L along with the base 110. At the same time, a distance by which the piston rod pivot shaft 152 swings upward is L*R. Therefore, a movement stroke of the vertical piston rod 151 with respect to the hydraulic buffer 150 is (L+L*R). Therefore, the movement stroke of the vertical piston rod 151 with respect to the hydraulic buffer 150 is one time or more of the movement distance L of the base 110. As the first connecting shaft 1431 on the upper swing arm 120*a* is closer to the right end of the upper swing arm 120*a*, the movement stroke is closer to one time of the movement distance L. In this case, swings of the upper swing arm 120*a* and the lower swing arm 120*b* are much reflected in the movement stroke of the vertical piston rod 151 with respect to the hydraulic buffer 150, and the energy absorption effect is good, thus being conducive to reducing the cost of the hydraulic buffer 150.

Continuously referring to FIG. 1 to FIG. 7, the internal structure of the stabilization apparatus 100 is further provided with a horizontal pushing mechanism for driving the scissor-shaped linkage mechanism to push the adsorption electromagnet 140 to approach the guide rail 11. In an embodiment, the horizontal pushing mechanism mainly includes a horizontal-push solenoid coil 130, a horizontal piston rod 134, and a horizontal-push connecting rod 133 as shown in the drawing. When the horizontal-push solenoid coil 130 is electrified, the horizontal piston rod 134 may be horizontally driven to move with respect to the horizontal-push solenoid coil 130 towards the negative X direction. An outer end of the horizontal piston rod 134 is connected to a right end of the horizontal-push connecting rod 133, thereby driving the horizontal-push connecting rod 133 to move towards the negative X direction, that is, move leftward, thus horizontally pushing the adsorption electromagnet 140 to move leftward. Therefore, the horizontal-push solenoid coil 130 can provide power for pushing the adsorption electromagnet 140 to approach the guide rail 11. The horizontal-push solenoid coil 130 may be horizontally fixed on the base 110 via, for example, a fixing bracket 132, and is also relatively located at the left side of the guide rail 11, that is, at the same side as the left end of the upper swing arm 120*a*. The horizontal-push connecting rod 133 crosses the guide rail 11 and having a right end connected to the scissor-shaped linkage mechanism, specifically connected to the central pin 142. The horizontal-push connecting rod 133 acts on the central pin 142, and may drive the central pin 142 to move towards the negative X direction. The scissor-shaped linkage mechanism is opened from the initial position, so that the adsorption electromagnet 140 is pushed by the scissor-shaped linkage mechanism to approach the guide rail 11.

The horizontal-push solenoid coil 130 may be enabled to work after being powered on or electrified. The specific structure and type of the horizontal-push solenoid coil 130 are not limited.

In an embodiment, the control over the horizontal-push solenoid coil 130 may be implemented by using a controller (not shown in the drawing). When the elevator car 13 stops moving in the shaft and is ready for passengers to enter or leave, the controller controls the horizontal-push solenoid coil 130 to be electrified, to push the adsorption electromagnet 140 to approach the guide rail 11. When the adsorption electromagnet 140 is substantially attached to the surface of the guide rail 11 or when the distance between the adsorption electromagnet 140 and the guide rail 11 is less than a predetermined spacing, or even when the adsorption electromagnet 140 contacts with the guide rail 11, the controller controls the horizontal-push solenoid coil 130 to be powered off. Specifically, the adsorption electromagnet 140 may also be controlled by the controller. For example, the adsorption electromagnet 140 is controlled to be powered on or electrified while the horizontal-push solenoid coil 130 is powered off. The adsorption electromagnet 140 generates a large adsorption force, and fully contacts with the guide rail 11 to be able to generate the maximum static frictional force of a predetermined magnitude. The control process may be implemented automatically, and is simple and convenient. Moreover, the adsorption electromagnet 140 first approaches and then adsorbs, so that the impact sound generated by the adsorption electromagnet 140 and the guide rail 11 during adsorption is small. Moreover, the horizontal-push solenoid coil 130 does not need maintain electrified for a long time, and therefore, less heat is generated by the horizontal-push solenoid coil 130, avoiding the problem of overheat.

In an embodiment, the horizontal pushing mechanism further includes a return spring (not shown in the drawing) and a return board 131. The return board 131 is fixedly disposed at the outermost end (that is, the left most end) of the horizontal piston rod 134, and two ends of the return spring are fixed to the return board 131 and the horizontal-push solenoid coil 130 respectively. When the horizontal-push connecting rod 133 is driven by the horizontal piston rod 134 to move towards the negative X direction (for example, when the horizontal-push solenoid coil 130 is electrified), the return board 131 is also pushed by the horizontal piston rod 134 to move towards the negative X direction. The distance between the return board 131 and the horizontal-push solenoid coil 130 is increased, and one or more return springs can generate increasingly larger tensile forces. Once the horizontal-push solenoid coil 130 is powered off and the adsorption electromagnet 140 is powered off, the tensile force generated by the return spring will push the horizontal piston rod 134 and the horizontal-push connecting rod 133 to move together towards the positive X direction. As a result, the horizontal piston rod 134 and the horizontal-push connecting rod 133 can return to initial positions, and the adsorption electromagnet 140 is also pushed to return to the initial position as shown in FIG. 1 and FIG. 3. In this way, the stabilization apparatus 100 will not interfere with the guide rail 11. The adsorption electromagnet 140 will not be stuck with the guide rail 11 when the elevator car 13 runs normally in the shaft. Meanwhile, preparation is made for the next work of the horizontal pushing mechanism.

It should be understood that the horizontal pushing mechanism is not limited to the apparatus driven by the solenoid coil as shown in the above embodiment, and may also be other types of driving apparatuses that provide horizontal drive, such as a small-sized motor.

Still referring to FIG. 1 to FIG. 7, the internal structure of the stabilization apparatus 100 is further provided with a reset component for enabling the upper swing arm 120*a*, the lower swing arm 120*b*, and the damper to be reset. In an embodiment, the reset component specifically includes a reset rod 160, an upper reset spring 164*a* (not shown in FIG. 1 and FIG. 3, referring to FIGS. 8*a*-8*c*) disposed at an upper section of the reset rod 160, a lower reset spring 164*b* (not shown in FIG. 1 and FIG. 3, referring to FIGS. 8*a*-8*c*) disposed at a lower section of the reset rod 160, and a reset rod supporting seat 161. The reset rod supporting seat 161 is fixed on the base 110 and swings vertically in the Z direction along with the elevator car 13. The upper end of the reset rod 160 is connected to the upper swing arm 120*b* via the pivot shaft 162*a*, and the reset rod 160 can rotate with respect to the upper swing arm 120*a* about the pivot shaft 162*a*. The lower end of the reset rod 160 is connected to the lower swing arm 120*b* via a pivot shaft 162*b*, and the reset rod 160 can rotate with respect to the lower swing arm 120*b* about the pivot shaft 162*b*. The middle part of the reset rod 160 is provided with a limiting sleeve 163 capable of sliding vertically, and the limiting sleeve 163 is fixed on the reset rod supporting seat 161.

Specifically, the pivot point at the left end of the upper swing arm 120*a* (that is, the position point corresponding to the upper swing arm pivot shaft 121*a*), the pivot point at the left end of the lower swing arm 120*b* (that is, the position point corresponding to the lower swing arm pivot shaft 121*b*), the connecting points of the reset rod 160 with the upper swing arm 121*a* and the lower swing arm 121*b* (that is, the position point corresponding to the pivot shaft 162*a* and the position point corresponding to the pivot shaft 162*b*) substantially form four angular points of a parallelogram. In an initial state (that is, when the stabilization apparatus 100 is in the non-working state), the parallelogram is a rectangle.

The pivot shaft 162*a* may be disposed in the middle between the pivot point at the left end of the upper swing arm 120*a* and the first connecting shaft 1431. The pivot shaft 162*b* may be disposed in the middle between the pivot point at the left end of the lower swing arm 120*b* and the second connecting shaft 1411. Specifically, the pivot shaft 162*a* may be disposed at a midpoint position between the pivot point at the left end of the upper swing arm 120*a* and the first connecting shaft 1431, and the pivot shaft 162*b* may be disposed at a midpoint position between the pivot point at the left end of the lower swing arm 120*b* and the second connecting shaft 1411.

The stabilization apparatus 100 exemplified above can enable the upper swing arm 120*a*, the lower swing arm 120*b*, and the damper to tend to reset, and specific principles are as follows:

By taking that the base 110 moves downward by the distance L as an example, the left ends of the upper swing arm 120*a* and the lower swing arm 120*b* also swing downward by the distance L, and the reset rod supporting seat 161 and the limiting sleeve 163 also swing downward by the distance L. Based on the level principle, the distance by which the pivot shaft 162*b* swings downward is less than L. Therefore, the lower reset spring 164*b* is compressed. When the adsorption electromagnet 140 is powered off, the lower reset spring 164*b* can generate a counter-acting force to push the lower swing arm 120*b*, thereby driving the upper swing arm 120*a* and the damper together to return to the initial positions as shown in FIG. 1 and FIG. 3 with respect to the base 110, thus preparing for the next work of the stabilization apparatus 100.

Figure 7:
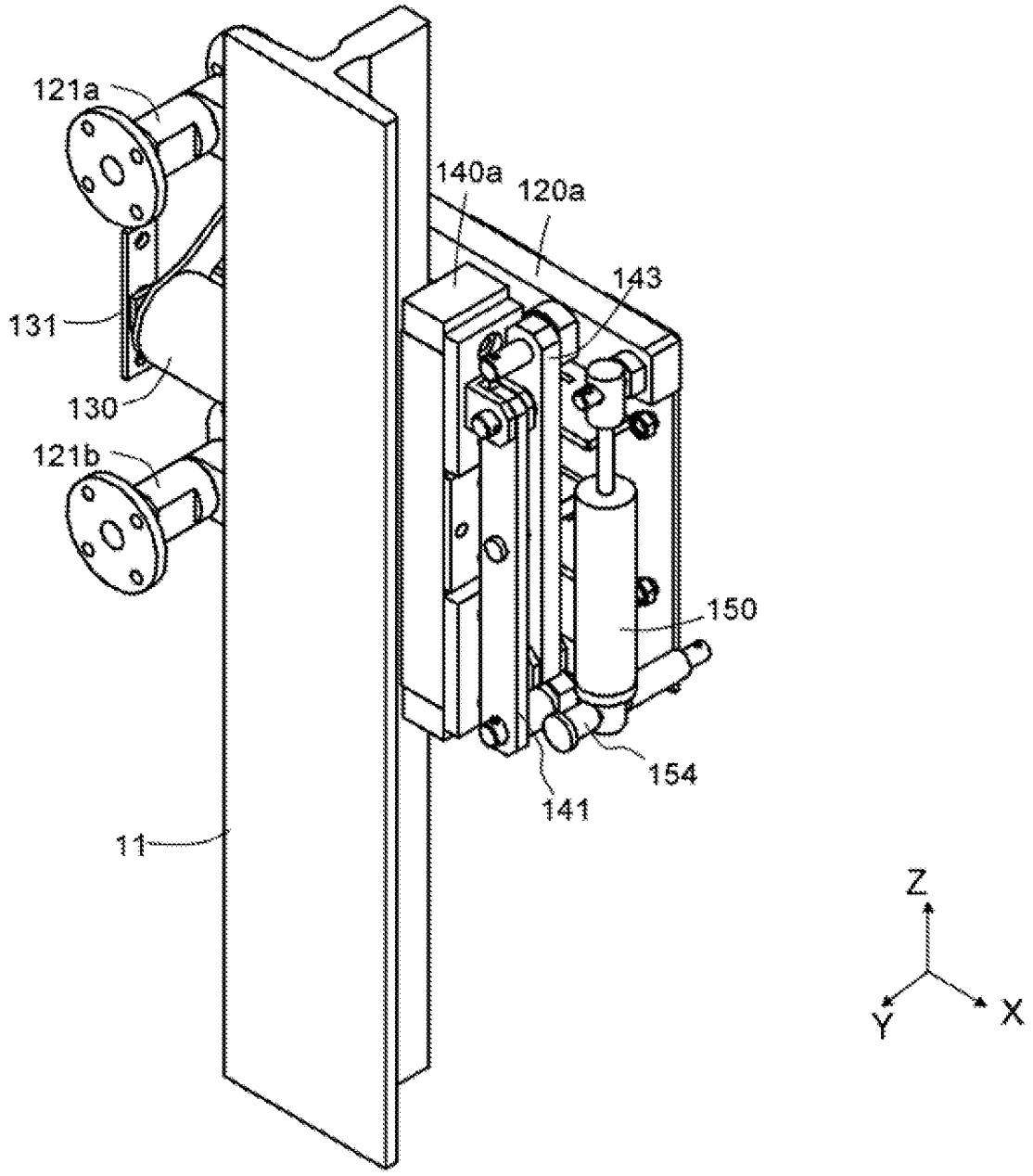
FIG. 7 is a schematic diagram showing mounting and positioning of the internal structure of the stabilization apparatus of the embodiment shown in FIG. 1 with respect to a guide rail.

The specific mounting manner of the stabilization apparatus 100 in the above embodiment is as shown in FIG. 5 and FIG. 7, wherein a mounting manner of one stabilization apparatus 100 in the elevator car 13 with respect to the guide rail 11 is shown, and a schematic partial structural diagram of the elevator system 10 according to an embodiment of the present invention is also shown. It should be appreciated that, multiple stabilization apparatuses 100 may be mounted on the elevator car 13 in the same manner. For example, one or more stabilization apparatuses 100 are mounted corresponding to each guide rail 11. Specifically, the stabilization apparatus 100 may be, but not limited to, fixedly mounted on the guide shoe 12 of the elevator car 13, for example, on the upper guide shoe, on the lower guide shoe, or on the upper guide shoe and the lower guide shoe simultaneously. Specifically, the mounting may be selected according to a principle of not affecting running of the elevator car 13 in the shaft.

The working principle of the stabilization apparatus according to the embodiment of the present invention is illustrated below with reference to FIG. 8.

Figure 8A:
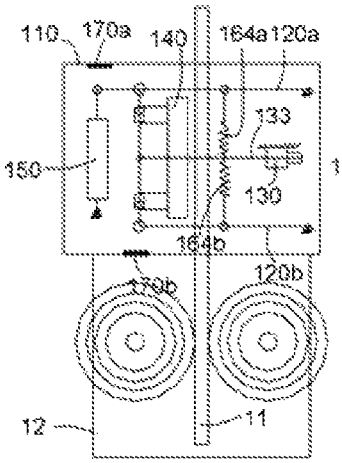
FIGS. 8*a*-8*c* are schematic diagrams of working principles of the stabilization apparatus of the embodiment shown in FIG. 1, wherein FIG. 8*a* schematically shows a state of the stabilization apparatus that does not work, FIG. 8*b* schematically shows that a guide rail friction member of the stabilization apparatus is at least partially fixed on the guide rail, and FIG. 8*c* schematically shows that the stabilization apparatus stops the elevator car from moving downward.

First, as shown in FIG. 8*a*, the stabilization apparatus 100 is in the non-working state, that is, in an initial state, and the damper, the guide rail friction member, the horizontal pushing mechanism, and the like are located at initial positions. At this time, the stabilization apparatus 100 does not affect the guide rail 11, and the elevator car 13 can move freely along the guide rail 11 under the control of an elevator controller.

Figure 8B:
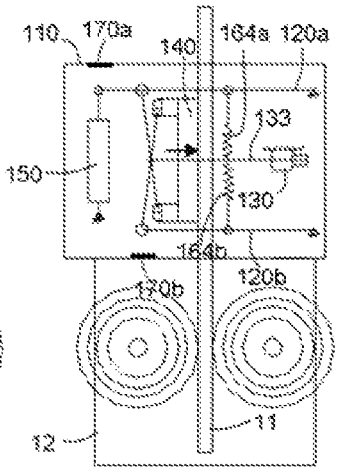

Further, as shown in FIG. 8*b*, when the elevator car 13 stops at a landing, and when the floor-door opens or before the floor-door opens, the controller of the stabilization apparatus 100 enables the horizontal-push solenoid coil 130 to be powered on, and the adsorption electromagnet 140 approaches the surface of the guide rail 11. At the same time, the controller of the stabilization apparatus 100 enables the adsorption electromagnet 140 to be powered on, and the adsorption electromagnet 140 of the guide rail friction member is adsorbed and fixed on the guide rail 11.

Figure 8C:
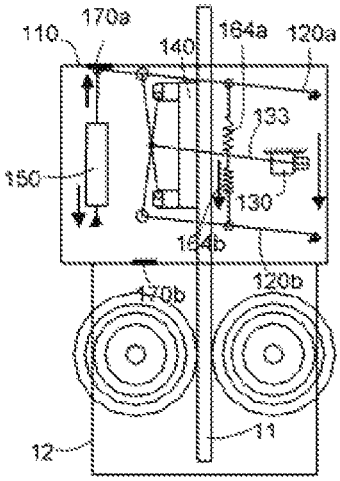

Further, as shown in FIG. 8*c*, if the elevator car 13 is loaded/unloaded, for example, passengers enter or leave the elevator car 13, or the like, changes in the weight of the elevator car 13 will cause a certain amount of elastic deformation of the steel belt 14. Therefore, obvious vibration in the vertical direction will be generated as the elastic deformation of the steel belt 14 is relatively large. By taking that the elevator car 13 moves downward during the vibration as an example, the base 110 will also move downward by a displacement L along with the elevator car 13. The static frictional force generated by the adsorption electromagnet 140 and the guide rail 11 fixes the adsorption electromagnet 140 with respect to the guide rail 11, and therefore, the internal structure of the parallelogram architecture of the stabilization apparatus 100 will swing with the first connecting shaft 1431 as a swing pivot. At this time, the upper swing arm 120*a* and the lower swing arm 120*b* also swing downward by the distance L (as shown by the arrow at the right of FIG. 8*c*), and the lower reset spring 164*b* on the reset rod 160 also swings downward by a distance less than L (as shown by the arrow in the middle of FIG. 8*c*) and is compressed by the reset rod supporting seat 161. The vertical piston rod 151 swings upward by a distance, and the hydraulic buffer 150 also moves downward by a displacement L (as shown by the arrow at the left of FIG. 8*c*). Therefore, the oil cylinder of the hydraulic buffer 150 can absorb at least part of the energy that enables the elevator car 13 to move downward, and can prevent the upper swing arm 120*a* and lower swing arm 120*b* from swinging downward. Therefore, the stabilization apparatus 100 can eliminate or alleviate the vibration of the elevator car 13 in the vertical direction. The elevator car 13 stops stably at a landing to provide desirable passenger experiences.

It will be appreciated that, if the elevator car 13 is ready to move in the shaft, the adsorption electromagnet 140 is powered off and is pushed by the horizontal-push connecting rod 133 back to the initial position shown in FIG. 8*a* under the effect of the return spring. Moreover, by means of the counter-acting force provided by the compressed upper reset spring 164*a* or lower reset spring 164*b*, the upper swing arm 120*a* and the lower swing arm 120*b* are restored to the initial positions shown in FIG. 8*a*. At the same time, the hydraulic buffer 150 and the vertical piston rod 151 are also restored to the initial positions shown in FIG. 8*a*.

In an embodiment, during working of the stabilization apparatus 100, a predetermined maximum static frictional force that can be generated when the adsorption electromagnet 140 is adsorbing the guide rail 11 may be set, in order to prevent the damper from being beyond its limit working condition during working, for example, to prevent the stroke of the vertical piston rod 151 with respect to the hydraulic buffer 150 from exceeding its limit stroke. Therefore, when the frictional force generated by the adsorption electromagnet 140 and the guide rail 11 equals to the predetermined maximum static frictional force, the damper works basically in the limit working condition, for example, the vertical piston rod 151 is substantially located in a limit up stroke or a limit down stroke. The predetermined maximum static frictional force will not be able to fix the elevator car 13 with respect to the guide rail 11 if passengers and/or articles loaded on or unloaded from the elevator car 13 are overweighted, that is, an acting force generated by the elevator car 13 and applied to the base 110 is greater than the predetermined maximum static frictional force. At this time, the adsorption electromagnet 140 will slide with respect to the guide rail 11, and the vertical piston rod 151 will not exceed the limit up stroke or the limit down stroke, thereby preventing the damper from working beyond its limit working condition and thus protecting it from damage. Specifically, the predetermined maximum static frictional force may be configured by selectively setting the material of the adsorption electromagnet 140, the frictional coefficient and/or magnitude of adsorption force of the surface of the adsorption electromagnet 140, and the like.

In an embodiment, the stabilization apparatus 100 is further provided with an upper limit switch 170*a* and a lower limit switch 170*b* (as shown in FIG. 2), to implement abrasion detection of the adsorption electromagnet 140 with respect to the guide rail 11 and instruct replacement of the adsorption electromagnet 140. Specifically, the upper limit switch 170*a* may be, but not limited to, mounted above the right end of the upper swing arm 120*a*, and the lower limit switch 170*b* may be, but not limited to, mounted below the right end of the lower swing arm 120*b*.

When the upper swing arm 120*a* and the lower swing arm 120*b* swing downward along with the elevator car 13 in the Z direction, and the acting force generated by the elevator car 13 and applied to the base 110 is greater than the predetermined maximum static frictional force, the adsorption electromagnet 140 will slide downward with respect to the guide rail 11 and trigger the lower limit switch 170*b*, to prevent the damper from working beyond the limit working condition. When the upper swing arm 120*a* and the lower swing arm 120*b* swing upward along with the elevator car 13 in the Z direction, and the acting force generated by the elevator car 13 and applied to the base 110 is greater than the predetermined maximum static frictional force, the adsorption electromagnet 140 will slide upward with respect to the guide rail 11 and trigger the upper limit switch 170*a*, to prevent the damper from working beyond the limit working condition. Specifically, positions of the lower limit switch 170*b* and the upper limit switch 170*a* on the base 110 may be set respectively, such that the sliding of the adsorption electromagnet 140 with respect to the guide rail 11 can trigger the lower limit switch 170*b* or the upper limit switch 170*a*. For example, as shown in FIG. 8(*c*), the piston rod 151 is substantially in a limit up stroke state, and if the adsorption electromagnet 140 and the base 110 slide downward with respect to the guide rail, one end of the upper swing arm 120*a* will touch and trigger the upper limit switch 170*a*.

In an embodiment, the stabilization apparatus 100 further includes a counter (not shown), which is configured to accumulate the number of times that the upper limit switch 170*a* and the lower limit switch 170*b* are triggered. The number of times correspondingly represents the number of times that the adsorption electromagnet 140 slides with respect to the guide rail 11. The counter is further configured to output a maintenance reminder signal for replacing the adsorption electromagnet 140, when the accumulated number of times is greater than or equal to a predetermined value. The magnitude of the predetermined value may be determined by experiments in advance according to specific characteristics of the adsorption electromagnet 140. The counter may be reset after the adsorption electromagnet 140 is replaced. If the adsorption electromagnet 140 is not maintained when the accumulated number of times is greater than or equal to the predetermined value, the counter may also send a signal to a controller of the adsorption electromagnet 140 to stop the next work of the adsorption electromagnet 140, for example, not electrify the adsorption electromagnet 140. In this way, the stabilization apparatus 100 is suspended from working, thus protecting the stabilization apparatus 100. The "accumulation" above may start from 0, and may also be inverse accumulation from a predetermined value.

It should be noted that, the positions of the upper limit switch 170*a* and the lower limit switch 170*b* are set on the base 110, such that either of the upper limit switch 170*a* and the lower limit switch 170*b* will not be pressed and triggered by a corresponding component when the damper basically works below the limit working condition.

It should be appreciated that the specific manner of disposing the counter is not limited. The counter may be formed in various control processors of the elevator system 10, or may be directly integrated in the upper limit switch 170*a* or the lower limit switch 170*b*.

Further, if the adsorption electromagnet 140 does not return to its initial position due to various reasons when the elevator car 13 runs normally along the guide rail 11, friction is very likely to occur between the adsorption electromagnet 140 moving along with the elevator car 13 and the guide rail 11, and thus the movement of the elevator car 13 is stuck. This should be avoided. In an embodiment, the upper limit switch 170*a* or the lower limit switch 170*b* is further configured to: output a signal if being triggered when the elevator car 13 runs normally along the guide rail 11 or being triggered continuously, to indicate that the adsorption electromagnet 140 does not return to its initial position. For example, if the movement is stuck, the adsorption electromagnet 140 will move upward or downward relatively under the effect of the frictional force, and meanwhile drive the upper swing arm 120*a* and the lower swing arm 120*b* to swing upward or downward. The right end of the upper swing arm 120*a*/lower swing arm 120*b* will continuously press the upper limit switch 170*a*/lower limit switch 170*b*. In this case, it indicates that the stuck phenomenon has been detected. The upper limit switch 170*a*/lower limit switch 170*b* outputs a signal to the elevator controller. The elevator controller may control, based on the signal, the elevator car 13 to stop at the nearest landing, to prepare for a subsequent rescuing process. The upper limit switch 170*a*/lower limit switch 170*b* may further output a signal to a remote monitoring system of the elevator system, to remind workers by sending an alarm. Therefore, the stabilization apparatus 100 according to the embodiment of the present invention can detect the stuck phenomenon timely, being conducive to timely maintenance and avoiding deterioration of the problem.

It should be appreciated that, the upper limit switch 170*a*/lower limit switch 170*b* is not limited to be triggered via press by the upper swing arm 120*a*/lower swing arm 120*b*. Other components in the parallelogram architecture where the upper swing arm 120*a* and the lower swing arm 120*b* are located may be correspondingly used for triggering the upper limit switch 170*a* or the lower limit switch 170*b*. For example, the upper limit switch 170*a* or the lower limit switch 170*b* is triggered by a component on the adsorption electromagnet 140. Therefore, the specific mounting position of the upper limit switch 170*a*/lower limit switch 170*b* is not limited to the above embodiment.

Second Embodiment

A stabilization apparatus 300 of an elevator car according to a second embodiment of the present invention is exemplified below in detail with reference to FIG. 9 to FIG. 15.

The stabilization apparatus 300 is mounted on an elevator car 13. The manner of mounting the stabilization apparatus 300 is basically the same as the manner of mounting the stabilization apparatus 300. Likewise, as shown in FIG. 5 and FIG. 6, the stabilization apparatus 300 may be mounted on a guide shoe 12 of the elevator car 13. The stabilization apparatus 300 may be mounted on an upper guide shoe or a lower guide shoe, or may be mounted on the upper guide shoe and the lower guide shoe simultaneously. Specifically, the mounting may be selected according to a principle of not affecting normal running of the elevator car 13 in a shaft. For example, the stabilization apparatus 300 may even be mounted on a component of the elevator car 13 other than the guide shoe 12. The major function of the stabilization apparatus 300 according to the embodiment of the present invention is reducing the vertical vibration of the elevator car 13 in the Z direction when the elevator car 13 stops at a landing of a floor (for example, when a floor-door of the landing is opened).

Figure 11:
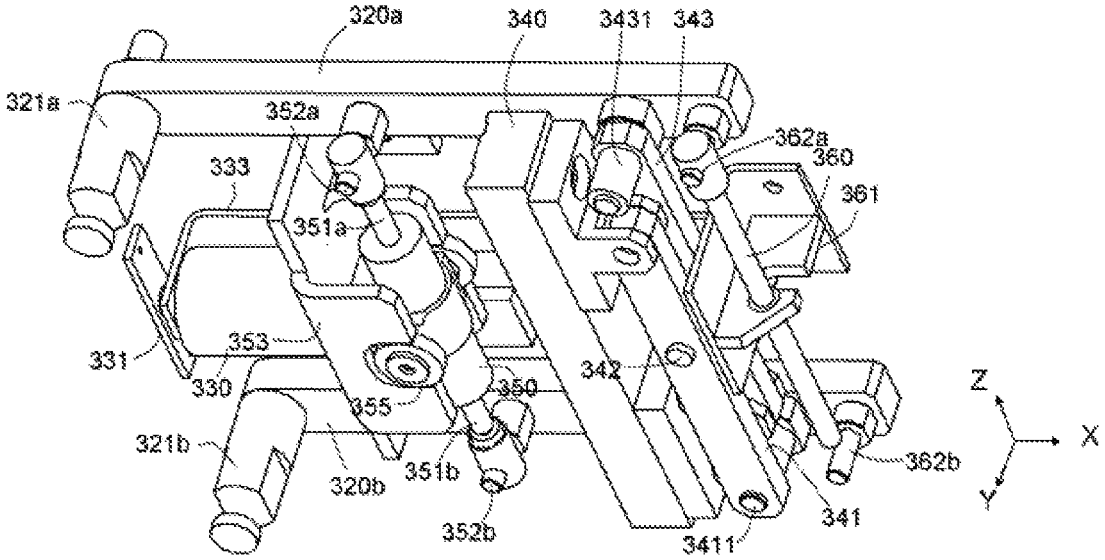
FIG. 11 is a three-dimensional schematic diagram of an internal structure of the stabilization apparatus of the embodiment shown in FIG. 9.
Figure 12:
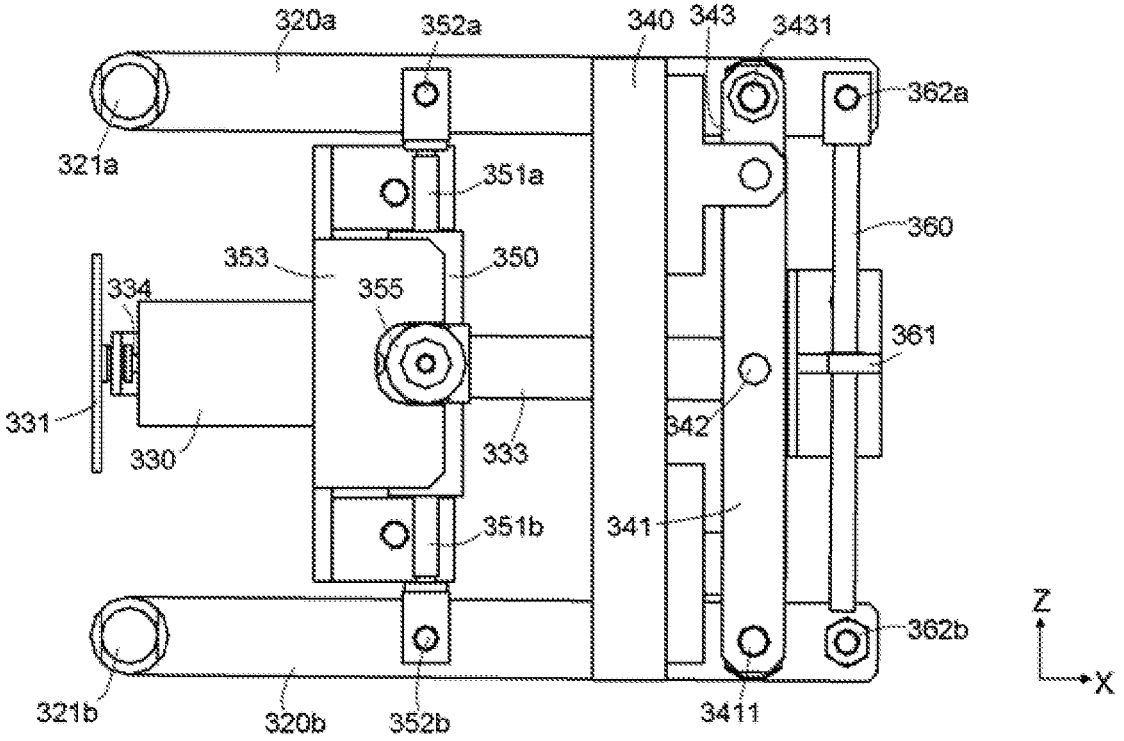
FIG. 12 is a front view of the internal structure of the stabilization apparatus of the embodiment shown in FIG. 9.
Figure 13:
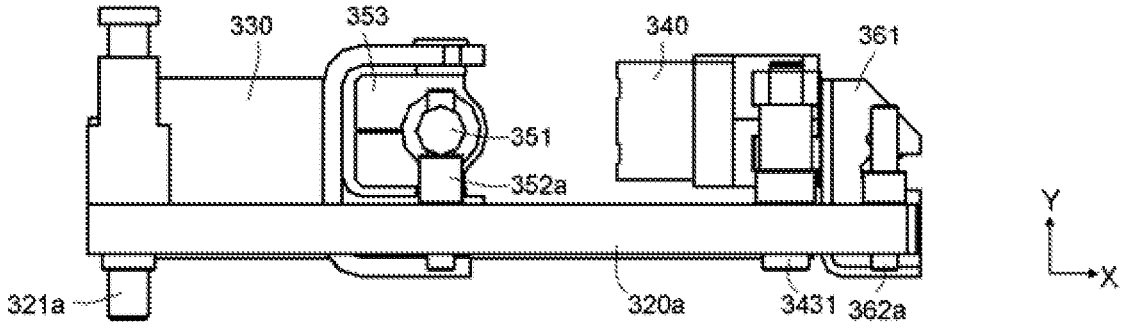
FIG. 13 is a top view of the internal structure of the stabilization apparatus of FIG. 14 is a schematic diagram showing mounting and positioning of the internal structure of the stabilization apparatus of the embodiment shown in FIG. 9 with respect to a guide rail.
Figure 14:
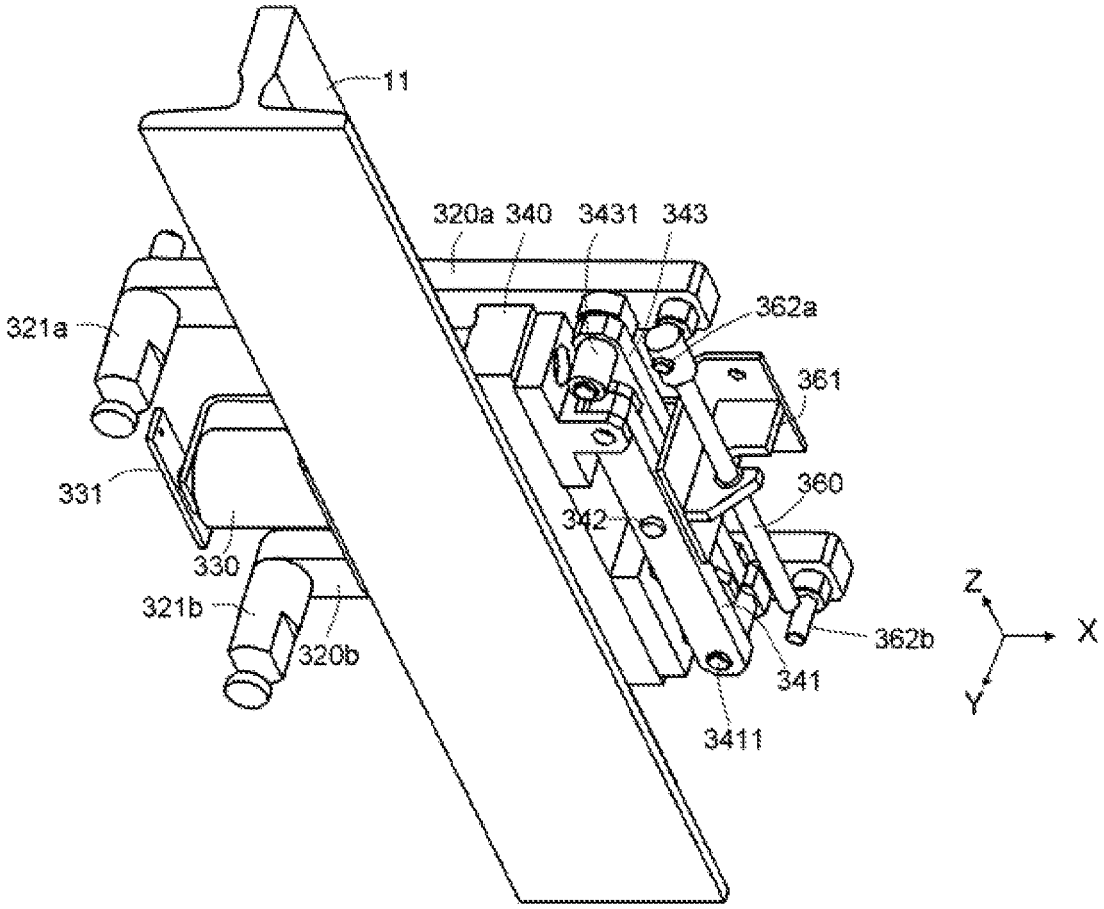

As shown in FIG. 9 to FIG. 14, the stabilization apparatus 300 includes a base 310. The base 310 is fixedly mounted relative to the elevator car 13, for example, fixedly mounted on the guide shoe 12 of the elevator car 13. In this embodiment, the base 310 may substantially be plate shaped. An upper edge of the plate is bent substantially perpendicularly towards the Y direction to form a base upper flange 310*a*, a lower edge of the plate is bent substantially perpendicularly towards the Y direction to form a base lower flange 310*b*, a left edge of the plate is bent substantially perpendicularly towards the Y direction and then bent substantially perpendicularly towards the X direction to form a base left flange 310*c*, and a right end cover 310*d* is detachably mounted at the right of the base 310. In this way, a semi-closed space is formed by enclosure of the base upper flange 310*a*, the base lower flange 310*b*, the base left flange 310*c*, and the right end cover 310*d*, to accommodate an internal structure of the stabilization apparatus 300 as shown in FIG. 11. Notches for accommodating a guide rail 11 may be formed on the base upper flange 310*a* and the base lower flange 310*b* respectively.

The internal structure of the stabilization apparatus 300 is provided with an upper swing arm 320*a* and a lower swing arm 320*b*. The upper swing arm 320*a* and the lower swing arm 320*b* are disposed substantially parallel to each other, wherein a left end of the upper swing arm 320*a* is pivotably fixed on the base 310. Specifically, the upper swing arm 320*a* is fixed on the base 310 via an upper swing arm pivot shaft 321*a* provided in the Y direction. In this way, the upper swing arm 320*a* may substantially rotate or swing about the upper swing arm pivot shaft 321*a* on a YZ plane, and a position point of the upper swing arm pivot shaft 321*a* on the upper swing arm 320*a* is a pivot point at a left end of the upper swing arm 320*a*. Likewise, the lower swing arm 320*b* is fixed on the base 310 via a lower swing arm pivot shaft 321*b* provided in the Y direction. In this way, the lower swing arm 320*b* may substantially rotate or swing about the lower swing arm pivot shaft 321*b* on the YZ plane, and a position point of the lower swing arm pivot shaft 321*b* on the lower swing arm 320*b* is a pivot point at a left end of the lower swing arm 320*b*. Specifically, both ends of the upper swing arm pivot shaft 321*a* and the lower swing arm pivot shaft 321*b* may be fixed to the base 310 and the base left flange 310*c* respectively.

The internal structure of the stabilization apparatus 300 is provided with a guide rail friction member capable of generating, with the guide rail 11, a frictional force for keeping static with respect to the guide rail 11, and having a first connecting shaft 3431 and a second connecting shaft 3411 for being connected to the upper swing arm 320*a* and the lower swing arm 320*b* respectively. Specifically, in this embodiment, the guide rail friction member is adsorbed on the guide rail 11 by using an electromagnet to generate a frictional force, and specifically includes an adsorption electromagnet 340 and a scissor-shaped linkage mechanism. The adsorption electromagnet 340 is fixed at one side, close to the guide rail 11, of the scissor-shaped linkage mechanism. The adsorption electromagnet 340 may generate an adsorption force on the guide rail 11 after being powered on or electrified, thereby generating the frictional force between surfaces of the adsorption electromagnet 340 and the guide rail 11. The specific type of the adsorption electromagnet 340 is not limited. A maximum static frictional force between the adsorption electromagnet 340 and the guide rail 11 may be controlled by setting a frictional coefficient of an adsorption plane of the adsorption electromagnet 340 and/or the magnitude of an adsorption force that can be generated by the adsorption electromagnet 340, or the like, that is, a predetermined maximum static frictional force is formed.

The scissor-shaped linkage mechanism is formed by a first connecting rod 341 and a second connecting rod 343 crossing each other. The first connecting rod 341 and the second connecting rod 343 are pivotally connected through a central pin 342. One end of the first connecting rod 341 is pivotably connected to an upper portion of the adsorption electromagnet 340, and the other end of the first connecting rod 341 is connected to the lower swing arm 320*b* via the second connecting shaft 3411. One end of the second connecting rod 343 is pivotably connected to a lower portion of the adsorption electromagnet 340, and the other end of the second connecting rod 343 is connected to the upper swing arm 320*a* via the first connecting shaft 3431. Moreover, the central pin 342 passes through pin holes in the middle of the first connecting rod 341 and the second connecting rod 343. The lengths of the first connecting rod 341 and the second connecting rod 343 are set (for example, they are set to have the same length) such that the adsorption plane of the adsorption electromagnet 340 fixed on the scissor-shaped linkage mechanism is basically parallel to the guide rail 11. In this case, when the central pin 342 is pulled towards the negative X direction, the scissor-shaped linkage mechanism may push the adsorption electromagnet 340 to approach or contact with the surface of the guide rail 11. When the central pin 342 is pushed towards the positive X direction, the scissor-shaped linkage mechanism may push the adsorption electromagnet 340 away from the surface of the guide rail 11 to return to an initial position. In the above process, the adsorption electromagnet 340 may be kept to move in the X direction, and it is unnecessary to set a guiding apparatus for the movement of the adsorption electromagnet 340 in the X direction. The structure is simple and the operation is convenient. Moreover, the scissor-shaped linkage mechanism may provide redundant rotation at a fine tuning angle on an XZ plane for the adsorption electromagnet 340, such that the adsorption electromagnet 340 can be completely attached to and contact with the surface of the guide rail 11 when applying an adsorption force. In an embodiment, the pin hole in the first connecting rod 341 or the second connecting rod 343 is set to a kidney shaped hole; this may increase the redundant rotation at the fine tuning angle.

In the stabilization apparatus 300 of this embodiment, the pivot point at the left end of the upper swing arm 320*a* (that is, the position corresponding to the upper swing arm pivot shaft 321*a*), the pivot point at the left end of the lower swing arm (that is, the position corresponding to the upper swing arm pivot shaft 321*b*), a connecting point of the first connecting shaft 3431 with the upper swing arm 320*a*, and a connecting point of the second connecting shaft 3411 with the lower swing arm 320*b* substantially form four angular points of a parallelogram. That is, the upper swing arm 320*a*, the lower swing arm 320*b*, and the guide rail friction member limit each other to substantially form a parallelogram. Moreover, it should be understood with reference to the following illustrations that, the shape of the parallelogram changes when the upper swing arm 320*a* and the lower swing arm 320*b* swing vertically along with the elevator car 13; however, side lengths thereof are not changed. When the stabilization apparatus 300 is in the non-working state, the adsorption electromagnet 340 is away from the surface of the guide rail 11. The parallelogram is substantially a rectangle. At this time, the upper swing arm 320*a*, the lower swing arm 320*b*, and the adsorption electromagnet 340 are correspondingly located at initial positions thereof.

Still referring to FIG. 9 to FIG. 14, the internal structure of the stabilization apparatus 300 is further provided with a damper. An upper end of the damper is pivotably connected to the upper swing arm 320*a*, and a lower end thereof is pivotably connected to the lower swing arm 320*b*. Connection positions of the upper end and the lower end of the damper on the upper swing arm 320*a* and the lower swing arm 320*b* are set such that the damper is located between the guide rail friction member and the upper swing arm pivot shaft 321*a*/lower swing arm pivot shaft 321*b*. Specifically, the damper includes a hydraulic buffer 350, an upper piston rod 351*a*, and a lower piston rod 351*b*. An upper end of the upper piston rod 351*a* is pivotably connected to the middle portion of the upper swing arm 320*a* via an upper piston rod pivot shaft 352*a*, for example, connected to a midpoint position between the pivot point at the left end of the upper swing arm 320*a* and the first connecting shaft 3431. A lower end of the lower piston rod 351*b* is pivotably connected to the middle portion of the lower swing arm 320*b* via a lower piston rod pivot shaft 352*b*, for example, connected to a midpoint position between the pivot point at the left end of the lower swing arm 320*b* and the second connecting shaft 3411. A hydraulic buffer bearing seat 353 is disposed corresponding to the damper, and is fixedly disposed with respect to the base 310. The hydraulic buffer bearing seat 353 may specifically be designed as a C-shaped bearing seat, and the hydraulic buffer 353 is enclosed by the C-shaped bearing seat. The hydraulic buffer 350 is supported on the base 310 via the hydraulic buffer bearing seat 353, and swings vertically along with the elevator car 13 in the Z direction.

In an embodiment, the damper as a whole is substantially parallel to a connecting line formed between the connecting point of the first connecting shaft 3431 with the upper swing arm 320*a* and the connecting point of the second connecting shaft 3411 with the lower swing arm 320*b*, that is, the damper disposed basically parallel to the guide rail friction member. The upper piston rod 351*a* and the lower piston rod 351*b* are disposed pivotably with respect to the upper swing arm 320*a* and the lower swing arm 320*b* respectively. In this way, the damper as a whole can rotate with respect to the upper swing arm 320*a* and the lower swing arm 320*b* at the same time substantially on the XZ plane.

It should be noted that, the hydraulic buffer 350 may include an oil cylinder and other structures. On one hand, when the base 310 moves vertically along with the elevator car 13, the hydraulic buffer 350 will also move vertically synchronously. On the other than, when the upper swing arm 320*a* swings with the first connecting shaft 3431 as a swing pivot, the upper piston rod pivot shaft 352*a* on the upper swing arm 320*a* will also swing vertically, thereby driving the upper piston rod 351*a* to move vertically. Likewise, when the lower swing arm 320*b* swings with the second connecting shaft 3411 as a swing pivot, the lower piston rod pivot shaft 352*b* on the lower swing arm 320*b* will also swing vertically, thereby driving the lower piston rod 351*b* to move vertically. Moreover, the upper swing arm 320*a* and the lower swing arm 320*b* swing synchronously. When the parallelogram structure where the upper swing arm 320*a* and the lower swing arm 320*b* are located swings with the first connecting shaft 3431 and the second connecting shaft 3411 as swing pivots. The upper piston rod 351*a* and the lower piston rod 351*b* can make piston movements with respect to the oil cylinder of the hydraulic buffer 350 respectively, to absorb swing energy of the upper swing arm 320*a* and the lower swing arm 320*b*, and alleviate the vibration in the vertical direction.

Specifically, by taking that the base 310 moves downward by a distance L as an example, the left ends of the upper swing arm 320*a* and the lower swing arm 320*b* also swing downward by the distance L, and the hydraulic buffer 350 also moves downward by the distance L along with the base 310. Meanwhile, a distance by which the upper piston rod pivot shaft 352*a* swings downward is L*R1, where R1 equals to a ratio of the distance between the upper piston rod pivot shaft 352*a* and a swing pivot (specifically, the first connecting shaft 3431) to the distance between the upper swing arm pivot shaft 321*a* (that is, the pivot point at the left end of the upper swing arm 320*a*) and the swing pivot. For example, R1=0.5. Based on the level principle, a movement stroke of the upper piston rod 351*a* with respect to the hydraulic buffer 350 is (L−L*R1), that is, a stretching stroke of the upper piston rod 351*a* with respect to the hydraulic buffer 350 is (L−L*R1). Meanwhile, a distance by which the lower piston rod pivot shaft 352*b* swings downward is L*R2, where R2 equals to a ratio of the distance between the lower piston rod pivot shaft 352*b* and a swing pivot (specifically, the second connecting shaft 3411) to the distance between the lower swing arm pivot shaft 321*b* (that is, the pivot point at the left end of the lower swing arm 320*a*) and the swing pivot. For example, R2=0.5. Based on the level principle, a movement stroke of the upper piston rod 351*a* with respect to the hydraulic buffer 350 is (L*R2−L), that is, a compression stroke of the lower piston rod 351*b* with respect to the hydraulic buffer 350 is (L−L*R2). Therefore, the upper piston rod 351*a* will generate an upward pulling force applied to the hydraulic buffer bearing seat 353, and the lower piston rod 351*b* will generate an upward pushing force applied to the hydraulic buffer bearing seat 353, thus at least partially preventing the upper swing arm 320*a* and the lower swing arm 320*b* from swinging downward while preventing the base 310 from moving downward.

Similarly, when the base 310 moves upward, the upper piston rod 351*a* will generate a downward pushing force applied to the hydraulic buffer bearing seat 353, and the lower piston rod 351*b* will generate a downward pulling force applied to the hydraulic buffer bearing seat 353, thus at least partially preventing the upper swing arm 320*a* and the lower swing arm 320*b* from swinging upward while preventing the base 310 from moving upward.

Therefore, the damper in the embodiment specifically disclosed above has characteristics of a double-rod bidirectional damper.

Moreover, the damper in the above embodiment is deployed at the left side of the guide rail 11. That is, the upper swing arm pivot shaft 321*a* and the lower swing arm pivot shaft 321*b* are located at the left side of the guide rail 11, and the guide rail friction member is located at the right side of the guide rail (referring to FIG. 14). In other words, the left end of the upper swing arm 320*a* and the left end of the lower swing arm 320*b* are located relatively at the left side of the guide rail 11; the upper swing arm pivot shaft 321*a* and the lower swing arm pivot shaft 321*b* of the damper are also located at the left side of the guide rail 11. The first connecting shaft 3431 and the second connecting shaft 3411 corresponding to the guide rail friction member are located at the right side of the guide rail 11 on the upper swing arm 320*a* and the lower swing arm 320*b* respectively. Therefore, the parallelogram architecture where the upper swing arm 320*a* is located can swing vertically as a whole with the first connecting shaft 3431 and the second connecting shaft 3411 as swing pivots.

In an embodiment, when the parallelogram structure where the upper swing arm 320*a* and the lower swing arm 320*b* are located swings with the first connecting shaft 3431 and the second connecting shaft 3411 as swing pivots, the damper not only swings vertically, but also swings slightly in the X direction in the actual process. Therefore, the C-shaped bearing seat serving as the hydraulic buffer bearing seat 353 is provided with two open slots correspondingly in the Y direction. The hydraulic buffer 350 is supported on the two open slots in the Z direction via two rollers respectively. Moreover, when the hydraulic buffer 350 swings vertically along with the elevator car 13, the hydraulic buffer 350 can move horizontally in the open slots via front and rear rollers 355. In this way, the hydraulic buffer 350 is allowed to move horizontally in the X direction at the same height. Specifically, the two open slots on the C-shaped bearing seat are both opened towards the guide rail 11.

Continuously referring to FIG. 1 to FIG. 7, the internal structure of the stabilization apparatus 300 is further provided with a horizontal pushing mechanism for driving the scissor-shaped linkage mechanism to push the adsorption electromagnet 340 to approach the guide rail 11. In an embodiment, the horizontal pushing mechanism mainly includes a horizontal-push solenoid coil 330, a horizontal piston rod 334, and a horizontal-push connecting rod 333 as shown in the drawing. When the horizontal-push solenoid coil 330 is electrified, the horizontal piston rod 334 may be horizontally driven to move with respect to the horizontal-push solenoid coil 330 towards the negative X direction. An outer end of the horizontal piston rod 334 is connected to a right end of the horizontal-push connecting rod 333, thereby driving the horizontal-push connecting rod 333 to move towards the negative X direction, that is, move leftward, thus horizontally pushing the adsorption electromagnet 340 to move leftward. Therefore, the horizontal-push solenoid coil 330 can provide power for pushing the adsorption electromagnet 340 to approach the guide rail 11. The horizontal-push solenoid coil 330 may be horizontally fixed on the base 110 via, for example, a fixing bracket (not shown), and is also relatively located at the left side of the guide rail 11, that is, at the same side as the left end of the upper swing arm 320*a*. The horizontal-push connecting rod 333 crosses the guide rail 11 and has a right end connected to the scissor-shaped linkage mechanism, specifically connected to the central pin 342. The horizontal-push connecting rod 333 acts on the central pin 342, and may drive the central pin 342 to move towards the negative X direction. The scissor-shaped linkage mechanism is opened from the initial position, so that the adsorption electromagnet 340 is pushed by the scissor-shaped linkage mechanism to approach the guide rail 11.

The horizontal-push solenoid coil 330 may be enabled to work by being powered on or electrified. The specific structure and type of the horizontal-push solenoid coil 330 are not limited.

In an embodiment, the control of the horizontal-push solenoid coil 330 may be implemented by using a controller (not shown in the drawing). When the elevator car 13 stops moving in the shaft and is ready for passengers to enter or leave, the controller controls the horizontal-push solenoid coil 330 to be powered on, to push the adsorption electromagnet 340 to approach the guide rail 11. When the adsorption electromagnet 340 is substantially attached to the surface of the guide rail 11 or when the distance between the adsorption electromagnet 340 and the guide rail 11 is less than a predetermined spacing, or even when the adsorption electromagnet 340 contacts with the guide rail 11, the controller controls the horizontal-push solenoid coil 330 to be powered off. Specifically, the adsorption electromagnet 340 may also be controlled by the controller. For example, the adsorption electromagnet 340 is controlled to be powered on or electrified while the horizontal-push solenoid coil 330 is powered off. The adsorption electromagnet 340 generates a large adsorption force, and fully contacts with the guide rail 11 to be able to generate the maximum static frictional force of a predetermined magnitude. The control process may be implemented automatically, and is simple and convenient. Moreover, the adsorption electromagnet 340 first approaches and then adsorbs, so that the impact sound generated by the adsorption electromagnet 340 and the guide rail 11 during adsorption is small. Moreover, the horizontal-push solenoid coil 330 does not need to maintain electrified for a long time, and therefore, less heat is generated by the horizontal-push solenoid coil 330, avoiding the problem of overheat.

Figure 9:
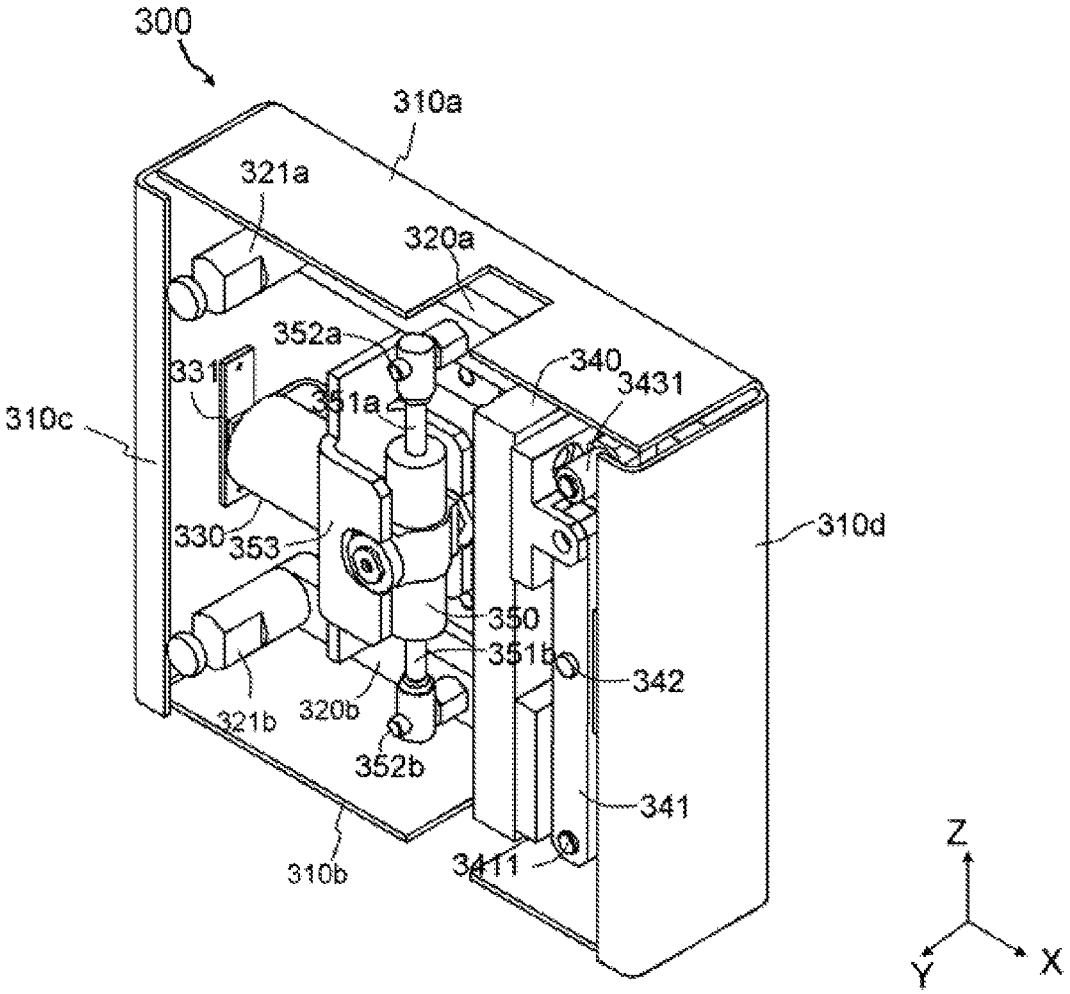
FIG. 9 is a three-dimensional schematic structural diagram of a stabilization apparatus of an elevator car according to a second embodiment of the present invention.
Figure 10:
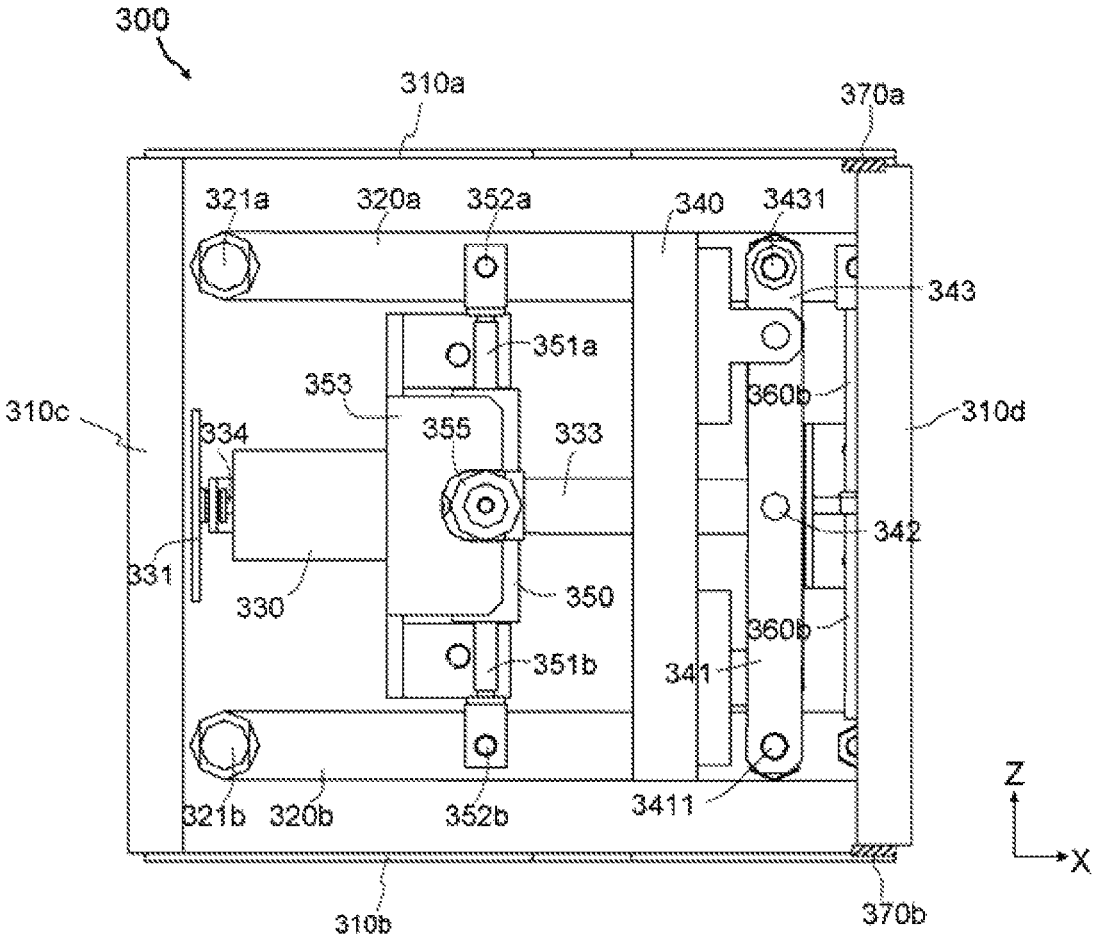
FIG. 10 is a front view of the stabilization apparatus of the embodiment shown in FIG. 9.

In an embodiment, the horizontal pushing mechanism further includes a return spring (not shown in the drawing) and a return board 331. The return board 331 is fixedly disposed at the outermost end (that is, the leftmost end) of a horizontal piston rod 334, and two ends of the return spring are fixed to the return board 331 and the horizontal-push solenoid coil 330 respectively. When the horizontal-push connecting rod 333 is driven by the horizontal piston rod 334 to move towards the negative X direction (for example, when the horizontal-push solenoid coil 330 is electrified), the return board 331 is also pushed by the horizontal piston rod 334 to move towards the negative X direction. The distance between the return board 331 and the horizontal-push solenoid coil 330 is increased, and one or more return springs can generate increasingly larger tensile forces. Once the horizontal-push solenoid coil 330 is powered off and the adsorption electromagnet 340 is powered off, the tensile force generated by the return spring will push the horizontal piston rod 334 and the horizontal-push connecting rod 333 to move together towards the positive X direction. As a result, the horizontal piston rod 334 and the horizontal-push connecting rod 333 can return to initial positions, and the adsorption electromagnet 340 is also pushed to return to the initial position as shown in FIG. 9 and FIG. 11. In this way, the stabilization apparatus 300 does not interfere with the guide rail 11. The adsorption electromagnet 340 is not stuck with the guide rail 11 when the elevator car 13 runs normally in the shaft. Meanwhile, preparation is made for the next work of the horizontal pushing mechanism.

It should be understood that the horizontal pushing mechanism is not limited to the apparatus driven by the solenoid coil as shown in the above embodiment, and may also be other types of driving apparatuses that provide horizontal drive, such as a small-sized motor.

Still referring to FIG. 9 to FIG. 14, the internal structure of the stabilization apparatus 300 is further provided with a reset component for enabling the upper swing arm 320*a*, the lower swing arm 320*b*, and the damper to be reset. In an embodiment, the reset component specifically includes a reset rod 360, an upper reset spring 364*a* (not shown in FIG. 9 to FIG. 14, referring to FIGS. 15*a*-15*c*) disposed at an upper section of the reset rod 360, a lower reset spring 364*b* (not shown in FIG. 9 and FIG. 14, referring to FIGS. 15*a*-15*c*) disposed at a lower section of the reset rod 360, and a reset rod supporting seat 361. The reset rod supporting seat 361 is fixed on the base 310 and swings vertically in the Z direction along with the elevator car 13. The upper end of the reset rod 360 is connected to the upper swing arm 320*b* via the pivot shaft 362*a*, and the reset rod 360 can rotate with respect to the upper swing arm 320*a* about the pivot shaft 362*a*. The lower end of the reset rod 360 is connected to the lower swing arm 320*b* via a pivot shaft 362*b*, and the reset rod 360 can rotate with respect to the lower swing arm 320*b* about the pivot shaft 362*b*. The middle part of the reset rod 360 is provided with a reset rod supporting seat 361. Ends, which are close to the reset rod supporting seat 361, of the upper reset spring 364*a* and the lower reset spring 364*b* are both pressed against the rest rod supporting seat 361. The other ends, which are close to the reset rod supporting seat 361, of the upper reset spring 364*a* and the lower reset spring 364*b* are also pressed against an upper end and a lower end of the reset rod 360 respectively.

Specifically, the pivot point at the left end of the upper swing arm 320*a* (that is, the position point corresponding to the upper swing arm pivot shaft 321*a*), the pivot point at the left end of the lower swing arm 320*b* (that is, the position point corresponding to the lower swing arm pivot shaft 321*b*), and connecting points of the reset rod 360 with the upper swing arm 321*a* and the lower swing arm 321*b* (that is, the position point corresponding to the pivot shaft 362*a* and the position point corresponding to the pivot shaft 362*b*) substantially form four angular points of a parallelogram. In an initial state (that is, when the stabilization apparatus 300 is in the non-working state), the parallelogram is a rectangle.

The pivot shaft 362*a* may be disposed at the right end of the upper swing arm 320*a*, and the pivot shaft 362*b* may be disposed at the right end of the lower swing arm 320*b*. The guide rail friction member is disposed as a whole close to and parallel to the reset rod 360. The guide rail friction member and the reset component are both located at the right side of the guide rail 11 relatively.

The stabilization apparatus 300 exemplified above can enable the upper swing arm 320*a*, the lower swing arm 320*b*, and the damper to tend to reset, and specific principles are as follows:

By taking that the base 310 moves downward by the distance L as an example, the left ends of the upper swing arm 320*a* and the lower swing arm 320*b* also swing downward by the distance L, and the reset rod supporting seat 361 also swings downward by the distance L. Based on the level principle, the pivot shaft 362*b* also swings upward by a certain distance, and therefore, the lower reset spring 364*b* is compressed. When the adsorption electromagnet 340 is powered off, the lower reset spring 364*b* can generate a counter-acting force to push the lower swing arm 320*b* downward and push the reset rod supporting seat 361 and the base 110 upward, thereby driving the upper swing arm 320*a* and the damper together to return to the initial positions as shown in FIG. 9 and FIG. 11 with respect to the base 310, thus preparing for the next work of the stabilization apparatus 300.

The specific mounting manner of the stabilization apparatus 300 in the above embodiment is the same as that of the stabilization apparatus 100 in the first embodiment, and will not be described again here.

The working principle of the stabilization apparatus according to the embodiment of the present invention is illustrated below with reference to FIGS. 15*a*-15*c*.

Figure 15A:
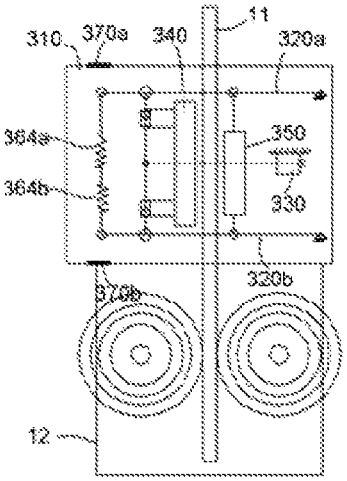
FIG. 15 is a schematic diagram of working principles of the stabilization apparatus of the embodiment shown in FIG. 9, wherein FIG. 15*a* schematically shows a state of the stabilization apparatus that does not work, FIG. 15*b* schematically shows that a guide rail friction member of the stabilization apparatus is at least partially absorbed and fixed on the guide rail, and FIG. 15 schematically shows that the stabilization apparatus stops the car from moving downward.

First, as shown in FIG. 15*a*) the stabilization apparatus 300 is in the non-working state, that is, in an initial state, and the damper, the guide rail friction member, the horizontal pushing mechanism, and the like are located at initial positions. At this time, the stabilization apparatus 300 does not affect the guide rail 11, and the elevator car 13 can move freely along the guide rail 11 under the control of an elevator controller.

Figure 15B:
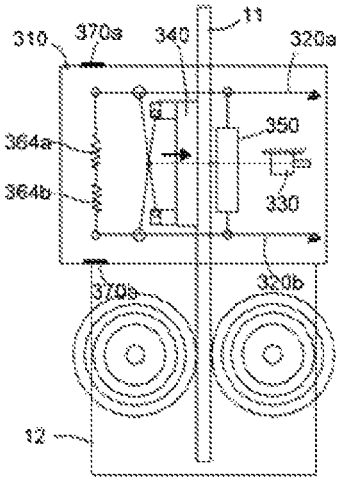

Further, as shown in FIG. 15*b*, when the elevator car 13 stops at a landing, and when the floor-door opens or before the floor-door opens, the controller of the stabilization apparatus 300 enables the horizontal-push solenoid coil 330 to be powered on, and the adsorption electromagnet 340 approaches the surface of the guide rail 11. At the same time, the controller of the stabilization apparatus 300 powers on the adsorption electromagnet 340, and the adsorption electromagnet 340 of the guide rail friction member is adsorbed and fixed on the guide rail 11.

Figure 15C:
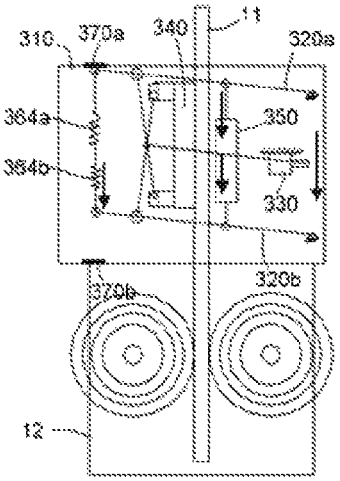

Further, as shown in FIG. 15*c*, if the elevator car 13 is loaded/unloaded, for example, passengers enter or leave the elevator car 13, or the like, changes in the weight of the elevator car 13 will cause a certain amount of elastic deformation of the steel belt 14. Therefore, obvious vibration in the vertical direction will be generated as the elastic deformation of the steel belt 14 is relatively large. By taking that the elevator car 13 moves downward during the vibration as an example, the base 310 will also move downward by a displacement L along with the elevator car 13. The static frictional force generated by the adsorption electromagnet 340 and the guide rail 11 fixes the adsorption electromagnet 340 with respect to the guide rail 11, and therefore, the internal structure of the parallelogram architecture of the stabilization apparatus 300 will swing with the first connecting shaft 3431 and the second connecting shaft 3411 as swing pivots. At this time, the upper swing arm 320*a* and the lower swing arm 320*b* also swing downward by the distance L (as shown by the arrow at the right of FIG. 15*c*), the hydraulic buffer 350 also moves downward with respect to the upper piston rod 351*a* (as shown by the arrow in the middle of FIG. 15*c*), and at the same time moves downward with respect to the lower piston rod 351*b* (as shown by the arrow in the middle of FIG. 15*c*) under the drive of the bearing seat thereof. The lower reset spring 364*b* on the reset rod 360 is also pressed downward and compressed by the reset rod supporting seat 361 (as shown by the arrow at the left of FIG. 15*c*). Therefore, the oil cylinder of the hydraulic buffer 350 can absorb at least part of the energy that enables the elevator car 13 to move downward, and can prevent the upper swing arm 320*a* and lower swing arm 320*b* from swinging downward. Therefore, the stabilization apparatus 300 can eliminate or alleviate the vibration of the elevator car 13 in the vertical direction. The elevator car 13 stops stably at a landing to provide desirable passenger experience.

It will be appreciated that, if the elevator car 13 intends to move in the shaft, the adsorption electromagnet 340 is powered off and is pushed by the traverse piston rod 333 back to the initial position shown in FIG. 15*a* under the effect of the return spring. Moreover, by means of the counter-acting force provided by the compressed upper reset spring 364*a* or the lower reset spring 364*b*, the upper swing arm 320*a* and the lower swing arm 320*b* are restored to the initial positions shown in FIG. 15*a*. At the same time, the hydraulic buffer 350, the upper piston rod 351*a*, and the lower piston rod 351*b* are also restored to the initial positions shown in FIG. 15(*a*).

In an embodiment, during working of the stabilization apparatus 300, a predetermined maximum static frictional force that can be generated when the adsorption electromagnet 340 is adsorbing the guide rail 11 may be set, in order to prevent the damper from being beyond its limit working condition when working, for example, to prevent the stroke of at least one of the upper piston rod 351*a* and the lower piston rod 351*b* with respect to the hydraulic buffer 350 from exceeding its limit stroke. Therefore, when the frictional force generated by the adsorption electromagnet 340 and the guide rail 11 equals to the predetermined maximum static frictional force, the damper works basically in the limit working condition, for example, at least one of the upper piston rod 351*a* and the lower piston rod 351*b* is substantially located in a limit up stroke or a limit down stroke. The predetermined maximum static frictional force will not be able to fix the elevator car 13 with respect to the guide rail 11 if passengers and/or articles loaded onto or unloaded from the elevator car 13 are over-weighted, that is, an acting force generated by the elevator car 13 and applied to the base 310 is greater than the predetermined maximum static frictional force. At this time, the adsorption electromagnet 340 will slide with respect to the guide rail 11, and the upper piston rod 351*a* or the lower piston rod 351*b* will not exceed the limit up stroke or the limit down stroke, thereby preventing the damper from working beyond its limit working condition and thus protecting it from damage. Specifically, the predetermined maximum static frictional force may be configured by selectively setting the material of the adsorption electromagnet 340, the frictional coefficient and/or magnitude of adsorption force of the surface of the adsorption electromagnet 340, and the like.

In an embodiment, the stabilization apparatus 300 is further provided with an upper limit switch 370*a* and a lower limit switch 370*b* (as shown in FIG. 2), to implement abrasion detection of the adsorption electromagnet 340 with respect to the guide rail 11 and instruct replacement of the adsorption electromagnet 340. Specifically, the upper limit switch 370*a* may be, but not limited to, mounted above the right end of the upper swing arm 320*a*, and the lower limit switch 370*b* may be, but not limited to, mounted below the right end of the lower swing arm 320*b*. The upper limit switch 370*a* and the lower limit switch 370*b* may specifically be micro switches, for example, may also be various types of proximity sensors that generate an action similar to switch triggering when a distance between the adsorption electromagnet 340 and the proximity sensor is less than a predetermined value.

When the upper swing arm 320*a* and the lower swing arm 320*b* swing downward along with the elevator car 13 in the Z direction, and the acting force generated by the elevator car 13 and applied to the base 310 is greater than the predetermined maximum static frictional force, the adsorption electromagnet 340 will slide downward with respect to the guide rail 11 and trigger the lower limit switch 370*b*, to prevent the damper from working beyond the limit working condition. When the upper swing arm 320*a* and the lower swing arm 320*b* swing upward along with the elevator car 13 in the Z direction, and the acting force generated by the elevator car 13 and applied to the base 310 is greater than the predetermined maximum static frictional force, the adsorption electromagnet 340 will slide upward with respect to the guide rail 11 and trigger the upper limit switch 370*a*, to prevent the damper from working beyond the limit working condition. Specifically, positions of the lower limit switch 370*b* and the upper limit switch 370*a* on the base 310 may be set respectively, such that the sliding of the adsorption electromagnet 340 with respect to the guide rail 11 can trigger the lower limit switch 370*b* or the upper limit switch 370*a*. For example, as shown in FIG. 15(*c*), the piston rod 151 is substantially in a limit up stroke state, and if the adsorption electromagnet 340 and the base 310 slide downward with respect to the guide rail, one end of the upper swing arm 320*a* will touch and trigger the upper limit switch 370*a*.

In an embodiment, the stabilization apparatus 300 further includes a counter (not shown), which is configured to accumulate the number of times that the upper limit switch 370*a* and the lower limit switch 370*b* are triggered. The number of times correspondingly represents the number of times that the adsorption electromagnet 340 slides with respect to the guide rail 11. The counter is further configured to output a maintenance reminder signal for replacing the adsorption electromagnet 340 when the accumulated number of times is greater than or equal to a predetermined value. The magnitude of the predetermined value may be determined by experiments in advance according to specific characteristics of the adsorption electromagnet 340. The counter may be reset after the adsorption electromagnet 340 is replaced. If the adsorption electromagnet 340 is not maintained when the accumulated number of times is greater than or equal to the predetermined value, the counter may also send a signal to a controller of the adsorption electromagnet 340 to stop the next work of the adsorption electromagnet 340, for example, not electrify the adsorption electromagnet 340. In this way, the stabilization apparatus 300 is suspended from working, thus protecting the stabilization apparatus 300.

It should be noted that, the positions of the upper limit switch 370*a* and the lower limit switch 370*b* are set on the base 310, such that either of the upper limit switch 370*a* and the lower limit switch 370*b* will not be pressed and triggered by a corresponding component when the damper basically works below the limit working condition.

It should be appreciated that the specific manner of disposing the counter is not limited. The counter may be formed in various control processors of the elevator system 10, or may be directly integrated in the upper limit switch 370*a* or the lower limit switch 370*b*.

Further, if the adsorption electromagnet 340 does not return to its initial position due to various reasons when the elevator car 13 runs normally along the guide rail 11, friction is very likely to occur between the adsorption electromagnet 340 moving along with the elevator car 13 and the guide rail 11, and thus the movement of the elevator car 13 is stuck. This should be avoided. In an embodiment, the upper limit switch 370*a* or the lower limit switch 370*b* is further configured to: if being triggered when the elevator car 13 runs normally along the guide rail 11 or being triggered continuously, output a signal to indicate that the adsorption electromagnet 340 does not return to its initial position. For example, if the movement is stuck, the adsorption electromagnet 340 will move upward or downward relatively under the effect of the frictional force, and meanwhile drive the upper swing arm 320*a* and the lower swing arm 320*b* to swing upward or downward. The right end of the upper swing arm 320*a*/lower swing arm 320*b* will continuously press the upper limit switch 370*a*/lower limit switch 370*b*. In this case, it indicates that the stuck phenomenon has been detected. The upper limit switch 370*a*/lower limit switch 370*b* outputs a signal to the elevator controller. The elevator controller may control, based on the signal, the elevator car 13 to stop at the nearest landing, to prepare for a subsequent rescuing process. The upper limit switch 370*a*/lower limit switch 370*b* may further output a signal to a remote monitoring system of the elevator system, to remind workers by sending an alarm. Therefore, the stabilization apparatus 300 according to the embodiment of the present invention can detect the stuck phenomenon timely, being conducive to timely maintenance and avoiding deterioration of the problem.

It should be appreciated that, the upper limit switch 370*a*/lower limit switch 370*b* is not limited to be triggered via press by the upper swing arm 320*a*/lower swing arm 320*b*. Other components in the parallelogram architecture where the upper swing arm 320*a* and the lower swing arm 320*b* are located may be correspondingly used for triggering the upper limit switch 370*a* or the lower limit switch 370*b*. For example, the upper limit switch 370*a* or the lower limit switch 370*b* is triggered by a component on the adsorption electromagnet 340. Therefore, the specific mounting position of the upper limit switch 370*a*/lower limit switch 370*b* is not limited to the above embodiment.

It should be noted that, the upper limit switch and the lower limit switch in the first embodiment and the second embodiment are not limited to be applied in the stabilization apparatus having a parallelogram internal structure formed by an upper swing arm and a lower swing arm. Any other stabilization apparatus that is clamped on the guide rail by using the adsorption electromagnet principle and reduces the vibration in the vertical direction may use the upper limit switch and the lower limit switch disclosed above to detect the abrasion of the adsorption electromagnet and/or detect that the adsorption electromagnet is stuck.

In the above text, the "steel belt" is a component that is at least used for dragging the elevator car and has a width value in a first direction greater than a thickness value in a second direction on a section perpendicular to the length direction, wherein the second direction is substantially perpendicular to the first direction.

The above embodiments mainly illustrate various stabilization apparatuses of the present invention, an elevator system using the stabilization apparatus, and an abrasion detection and stuck detection method for an adsorption electromagnet in the stabilization apparatus. Some implementation manners of the present invention are described; however, those of ordinary skill in the art should understand that the present invention may be implemented in many other forms without departing from the substance and scope thereof. Therefore, the displayed examples and implementations are considered as schematic rather than limitative, and the present invention may incorporate various modifications and replacements without departing from the spirit and scope of the present invention defined in the appended claims.

What is claimed is:

1. A stabilization apparatus of an elevator car, comprising:

a base fixedly mounted with respect to the elevator car;

an upper swing arm and a lower swing arm disposed in parallel basically, first ends thereof being pivotably fixed to the base;

a guide rail friction member capable of generating, with a guide rail, a frictional force for keeping static with respect to the guide rail, and having a first connecting shaft and a second connecting shaft for being connected to the upper swing arm and the lower swing arm respectively;

a pushing mechanism configured to drive the guide rail friction member to approach the guide rail; and a damper having at least one end connected to the upper swing arm or the lower swing arm;

wherein the damper is configured to at least partially prevent the upper swing arm and the lower swing arm from swinging relative to each other, with the first connecting shaft and/or the second connecting shaft as a swinging pivot, along with the elevator car in a direction of the guide rail;

wherein a pivot point at the first end of the upper swing arm, a pivot point at the first end of the lower swing arm, a connecting point of the first connecting shaft with the upper swing arm, and a connecting point of the second connecting shaft with the lower swing arm form four angular points of a first parallelogram;

wherein an upper end of the damper is connected to a second end of the upper swing arm, and a lower end of the damper is pivotably connected to the base;

wherein the first end of the upper swing arm is relatively located at a first side of the guide rail, the second end of the upper swing arm is relatively located at a second side of the guide rail opposite to the first side, and the first connecting shaft is also relatively located at the second side of the guide rail on the upper swing arm.

2. The stabilization apparatus of claim 1, wherein a distance between a connecting point of the damper with the upper swing arm and the first connecting shaft is less than or equals to ½ of a distance between the pivot connecting point and the first connecting shaft.

3. The stabilization apparatus of claim 2, wherein the first connecting shaft is disposed on the upper swing arm close to the second end of the upper swing arm.

4. The stabilization apparatus of claim 1, wherein the damper comprises a hydraulic buffer and a vertical piston rod.

5. The stabilization apparatus of claim 4, wherein a lower end of the hydraulic buffer is pivotably fixed to a hydraulic buffer bearing seat via a hydraulic buffer pivot shaft, and the hydraulic buffer bearing seat is fixed on the base.

6. The stabilization apparatus of claim 1, further comprising a reset component enabling the upper swing arm, the lower swing arm, and the damper to reset, the reset component and the damper being located at different sides of the guide rail friction member respectively.

7. The stabilization apparatus of claim 6, wherein connecting points of the reset component with the upper swing arm and the lower swing arm are both relatively located at the first side of the guide rail on the upper swing arm and the lower swing arm.

8. The stabilization apparatus of claim 7, wherein the connecting point of the reset component with the upper swing arm is located at a midpoint position between the pivot point at the first end of the upper swing arm and the first connecting shaft, and the connecting point of the reset component with the lower swing arm is located at a midpoint position between the pivot point at the first end of the lower swing arm and the second connecting shaft.

9. The stabilization apparatus of claim 6, wherein the pivot point at the first end of the upper swing arm, the pivot point at the first end of the lower swing arm, and the connecting points of the reset component with the upper swing arm and the lower swing arm form four angular points of a second parallelogram.

10. The stabilization apparatus of claim 6, wherein the reset component comprises a reset rod, an upper reset spring disposed on the reset rod, a lower reset spring disposed on the reset rod, and a reset rod supporting seat;

wherein the reset rod supporting seat is fixed on the base and swings vertically along with the elevator car with respect to the reset rod in the direction of the guide rail; an upper end of the reset rod is connected to the upper swing arm via a pivot shaft, and a lower end of the reset rod is connected to the lower swing arm via a pivot shaft.

11. The stabilization apparatus of claim 10, wherein the upper reset spring is compressed when the reset rod supporting seat swings upward along with the elevator car, and the lower reset spring is compressed when the reset rod supporting seat swings downward along with the elevator car.

12. The stabilization apparatus of claim 1, wherein the guide rail friction member comprises an adsorption electromagnet and a scissor-shaped linkage mechanism, and the adsorption electromagnet is fixed to one side, close to the guide rail, of the scissor-shaped linkage mechanism.

13. The stabilization apparatus of claim 12, wherein the scissor-shaped linkage mechanism comprises a first connecting rod, a second connecting rod, and a central pin configured to pivotably connect the first connecting rod and the second connecting rod;

wherein a first end of the first connecting rod is pivotably connected to an upper portion of the adsorption electromagnet, a second end of the first connecting rod is connected to the lower swing arm via the second connecting shaft; a first end of the second connecting rod is pivotably connected to a lower portion of the adsorption electromagnet, and a second end of the second connecting rod is connected to the upper swing arm via the first connecting shaft.

14. The stabilization apparatus of claim 12, wherein the pushing mechanism comprises a horizontal pushing mechanism configured to drive the scissor-shaped linkage mechanism to push the adsorption electromagnet to approach the guide rail.

15. The stabilization apparatus of claim 14, wherein the horizontal pushing mechanism comprises a horizontal-push solenoid coil, a horizontal piston rod, and a horizontal-push connecting rod, the horizontal-push solenoid coil is fixedly disposed on the base and is located at the same side of the guide rail as the first end of the upper swing arm, the horizontal piston rod is able to be driven by the horizontal-push solenoid coil to move in a direction away from the adsorption electromagnet, a first end of the horizontal-push connecting rod is connected to the horizontal piston rod, and a second end of the horizontal-push connecting rod is connected to the scissor-shaped linkage mechanism.

16. The stabilization apparatus of claim 15, further comprising a controller configured to:

electrify the horizontal-push solenoid coil when the elevator car stops moving, to push the adsorption electromagnet to approach the guide rail, and power off the horizontal-push solenoid coil and electrify the adsorption electromagnet when the adsorption electromagnet contacts with the guide rail.

17. The stabilization apparatus of claim 14, wherein the horizontal pushing mechanism further comprises a return spring and a return board, the return board is fixed at an outer end of the piston rod, and two ends of the return spring are fixed to the return board and the horizontal-push solenoid coil respectively.

18. The stabilization apparatus of claim 12, wherein the adsorption electromagnet is configured to be able to generate a predetermined maximum static frictional force when adsorbing the guide rail, and the damper basically works below a limit working condition when the frictional force is less than or equal to the predetermined maximum static frictional force.

19. The stabilization apparatus of claim 18, further comprising an upper limit switch and a lower limit switch;

wherein the adsorption electromagnet slides downward with respect to the guide rail and triggers the lower limit switch when the upper swing arm and the lower swing arm swing downward along with the elevator car in the direction of the guide rail and an acting force generated by the elevator car and applied to the base is greater than the predetermined maximum static frictional force; and wherein the adsorption electromagnet slides upward with respect to the guide rail and triggers the upper limit switch when the upper swing arm and the lower swing arm swing upward along with the elevator car in the direction of the guide rail and an acting force generated by the elevator car and applied to the base is greater than the predetermined maximum static frictional force.

20. The stabilization apparatus of claim 19, further comprising a counter configured to accumulate the number of times that the upper limit switch and the lower limit switch are triggered.

21. The stabilization apparatus of claim 20, wherein the counter is further configured to output a signal for replacing the adsorption electromagnet and/or a signal for suspending the work of the stabilization apparatus when the accumulated number of times is greater than or equal to a predetermined value.

22. The stabilization apparatus of claim 1, wherein the base is fixedly mounted to an upper guide shoe and/or a lower guide shoe of the elevator car.

23. The stabilization apparatus of claim 1, further comprising an upper limit switch and/or a lower limit switch, wherein the upper limit switch/lower limit switch is further configured to output a signal if being triggered when the elevator car runs normally along the rail or being triggered continuously, to indicate that an adsorption electromagnet does not return to its initial position.

24. The stabilization apparatus of claim 23, wherein the upper limit switch is mounted above the second end of the upper swing arm, and the lower limit switch is mounted below the second end of the lower swing arm.

25. An elevator system, comprising a steel belt, an elevator car, and a guide rail, and further comprising the stabilization apparatus of claim 1.

* * * * *